US007927033B2

(12) United States Patent
Gansebom et al.

(10) Patent No.: US 7,927,033 B2
(45) Date of Patent: Apr. 19, 2011

(54) ACCESSORY MOUNT FOR A PRESSURIZED FLUID DELIVERY APPARATUS

(75) Inventors: Neil Gansebom, Madison, WI (US); Brian Beutter, Madison, WI (US); Steve Fiacchino, Port Washington, WI (US); Brian D. Neeley, West Bend, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 1294 days.

(21) Appl. No.: 11/498,671

(22) Filed: Aug. 3, 2006

(65) Prior Publication Data

US 2008/0031678 A1 Feb. 7, 2008

(51) Int. Cl.
*A47L 13/26* (2006.01)

(52) U.S. Cl. ..... 401/139; 401/290

(58) Field of Classification Search ..... 401/48, 401/139, 140, 282, 289, 290
See application file for complete search history.

(56) References Cited

U.S. PATENT DOCUMENTS

| | | | | |
|---|---|---|---|---|
| 1,663,439 | A * | 3/1928 | Christianson | 401/284 |
| 1,949,904 | A | 3/1934 | Guedel | |
| 2,638,730 | A | 8/1950 | Davidson | |
| 2,746,072 | A | 4/1954 | Lumpkin | |
| 3,423,027 | A | 1/1969 | Small et al. | |
| 3,508,709 | A | 4/1970 | Small et al. | |
| 3,748,678 | A * | 7/1973 | Ballou | 15/24 |
| 4,552,476 | A * | 11/1985 | Heraty et al. | 401/136 |
| 4,892,251 | A | 1/1990 | Bresnen | |
| 5,477,583 | A | 12/1995 | Deloe | |
| 6,247,658 | B1 | 6/2001 | Bakas | |
| 6,322,006 | B1 | 11/2001 | Guo | |
| 6,688,540 | B1 | 2/2004 | Passarella | |
| 6,776,363 | B1 | 8/2004 | Falletta et al. | |
| 6,786,431 | B2 | 9/2004 | Song | |
| 6,929,198 | B2 | 8/2005 | Dexter | |
| 2004/0140379 | A1 | 7/2004 | Dexter | |
| 2005/0081899 | A1 | 4/2005 | Shannon | |
| 2006/0038033 | A1 | 2/2006 | Daley | |

OTHER PUBLICATIONS

Heffco Corp., "Clean Like A Pro With The Deckmaster", brochure, 2 pages, published at least as early as Jun. 1, 2005.

* cited by examiner

*Primary Examiner* — Huyen Le
(74) *Attorney, Agent, or Firm* — Michael Best & Friedrich LLP

(57) ABSTRACT

The present invention provides a mount configured to couple a cleaning accessory to a wand of a pressurized fluid delivery apparatus. The mount includes a first receiving portion configured to receive the wand therein. The first receiving portion defines a first axis along which the wand is slidable. The mount also includes a locking member configured to secure the first receiving portion to the wand and a second receiving portion extending from the first receiving portion. The second receiving portion is configured to connect to an end of the cleaning accessory.

21 Claims, 20 Drawing Sheets

ACCESSORY MOUNT FOR A PRESSURIZED FLUID DELIVERY APPARATUS

FIELD OF THE INVENTION

The present invention relates to pressure washers, and more particularly to accessories for use with pressure washers.

BACKGROUND OF THE INVENTION

Pressure washers provide a highly-pressurized spray of water, or other liquid, for cleaning or other purposes. When used for cleaning, pressure washers are especially useful when cleaning large areas or large surfaces, such as, for example, vehicle panels, decks, fences, driveways, patios, windows, and siding.

When using a pressure washer to clean such large areas or surfaces, one or more accessories or hand tools are sometimes used by the operator of the pressure washer to facilitate the cleaning of the large area or surface. For example, the operator may use a brush to clean portions of the large area or surface that are difficult to reach or that are not effectively cleaned by the pressurized spray. Usually, this requires the operator to switch between using the pressure washer and the hand tool, which can be time consuming and physically cumbersome.

SUMMARY OF THE INVENTION

The present invention provides, in one aspect, a mount configured to couple one of a plurality of cleaning accessories to a wand of a pressurized fluid delivery apparatus. The mount includes a first receiving portion configured to receive the wand therein. The first receiving portion defines a first axis along which the wand is slidable. The mount also includes a locking member configured to secure the first receiving portion to the wand and a second receiving portion extending from the first receiving portion. The second receiving portion is configured to connect to an end of the cleaning accessory.

The present invention provides, in another aspect, a pressurized fluid delivery apparatus including a pump configured to provide a pressurized fluid and a wand configured to receive the pressurized fluid from the pump. The wand defines a first axis. The pressurized fluid delivery apparatus also includes a cleaning accessory and a mount coupling the cleaning accessory to the wand. The mount includes a first receiving portion to receive the wand therein. The first receiving portion is slidable along the first axis of the wand. The mount also includes a locking member to secure the first receiving portion to the wand and a second receiving portion extending from the first receiving portion. The second receiving portion connects to an end of the cleaning accessory.

The present invention provides, in yet another aspect, a roller assembly configured to be coupled to a wand of a pressurized fluid delivery apparatus. The roller assembly includes a first roller defining a first axis, a second roller aligned with the first axis, and a guide member defining a second axis substantially parallel to the first axis and spaced from the first axis. The roller assembly also includes a frame coupling the first roller, the second roller, and the guide member. The roller assembly further includes a connector extending from the frame. The connector is configured to couple the frame to the wand.

The present invention provides, in yet another aspect, a handle assembly configured to be coupled to a wand of a pressurized fluid delivery apparatus. The handle assembly includes a clamp having a first portion, and a second portion pivotably coupled to the first portion. The wand is positioned between the first portion and the second portion. The handle assembly also includes a handle having a fastener projecting therefrom. The fastener couples the handle to the clamp and engages the second portion to clamp the second portion against the wand upon relative rotation between the handle and the clamp.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
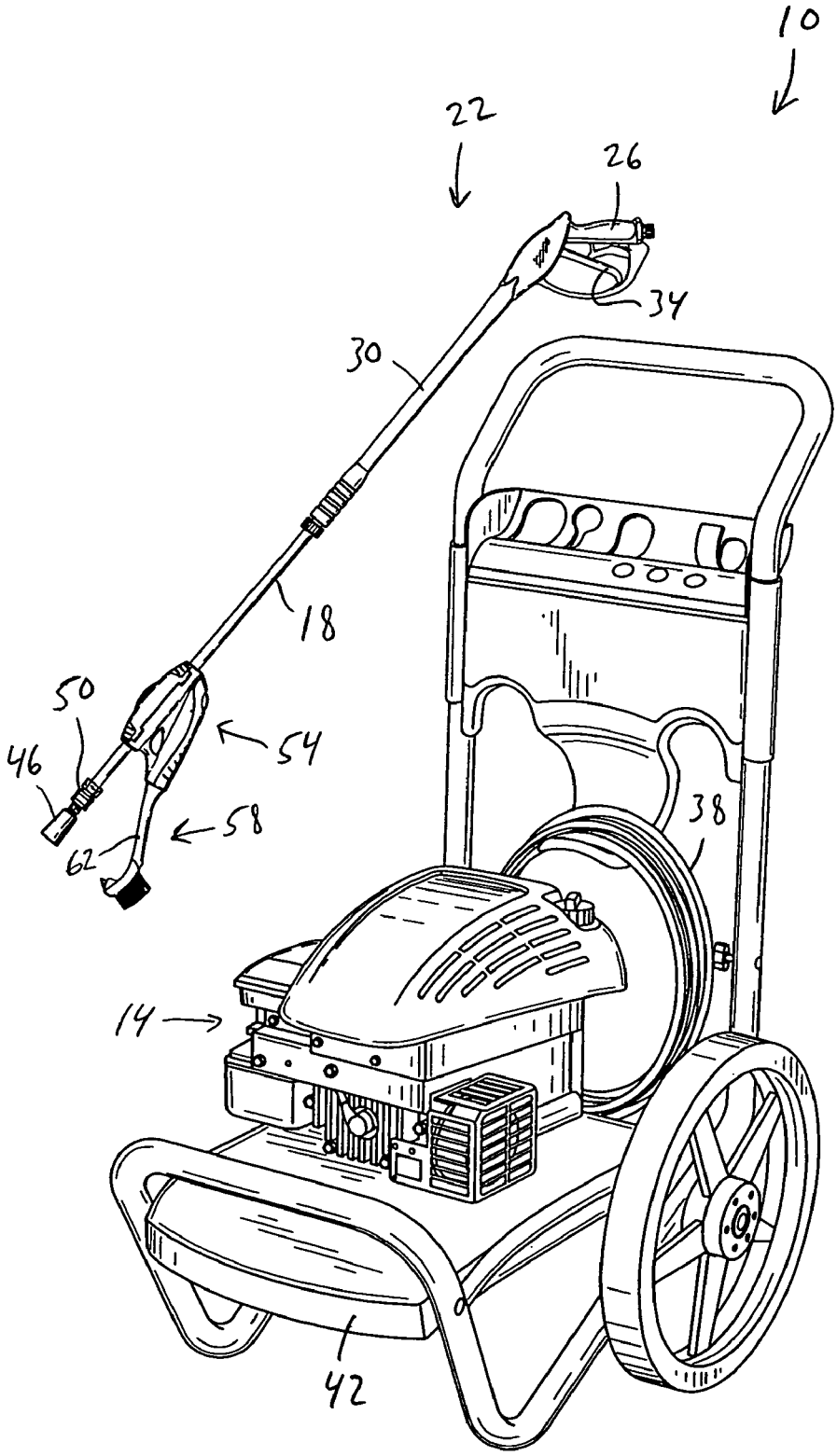
FIG. 1 is a front perspective view of a pressurized fluid delivery apparatus of the present invention, illustrating a gun assembly, a wand, and a mount coupling an accessory to the wand.

FIG. 1 illustrates a pressurized fluid delivery apparatus or pressure washer 10 including a power unit 14 to provide a pressurized liquid or fluid to a rigid conduit or wand 18. The power unit 14 may comprise an engine, electric motor, or other power unit. A pump is operatively coupled to the power unit 14 to provide the pressurized liquid. As understood in the art, the pump may receive a supply of low-pressure fluid, pressurize the fluid, and discharge the pressurized fluid to the wand 18. The wand 18 is coupled to a gun assembly 22 and acts as an extension to the gun assembly 22. The gun assembly 22 includes a hand grip 26 for an operator to grasp with one hand, and a barrel 30 for the operator to grasp with the other hand. A trigger 34 is located near the hand grip 26 to allow the operator to selectively operate the gun assembly 22. The gun assembly 22 is fluidly connected with the pump by a flexible hose 38, which allows the power unit 14 and pump to remain in one place while the operator moves around and operates the gun assembly 22. Any number of conventional fluid couplings may be used to fluidly connect and secure the hose 38 to the pump and to the gun assembly 22, respectively. Further, the power unit 14 and pump may be transportable by a wheeled cart 42. However, the cart 42 is not an essential component of the pressure washer 10.

FIG. 1 also illustrates a nozzle 46 coupled to the wand 18. The pressurized fluid exits the wand 18 via the nozzle 46. The illustrated nozzle 46 is configured to output a fixed spray angle, however, other fluid accessories may be used to output variable spray patterns. For example, an adjustable fluid accessory may be used to shape the discharged pressurized fluid into a spray pattern desirable for performing specific high-pressure cleaning applications. The adjustable fluid accessory may be adjusted to provide a wide-angle spray pattern to clean a large surface, however, the adjustable fluid accessory may also be adjusted to provide a narrow-angle spray pattern to clean a small surface. The adjustable fluid accessory may also include an adjustable nozzle assembly to affect the pressure of the discharged fluid. Another fluid accessory (e.g., a "turbo" nozzle) may output a rotating spray pattern. Further, other fluid accessories, such as a rotating brush, may be used in place of the fixed-spray angle nozzle 46. The nozzle 46 is coupled to the wand 18 by a quick-disconnect coupling 50. As such, the illustrated nozzle 46 may be removed and replaced with a different fluid accessory, such as the adjustable fluid accessory or the "turbo" nozzle described above.

Figure 2:
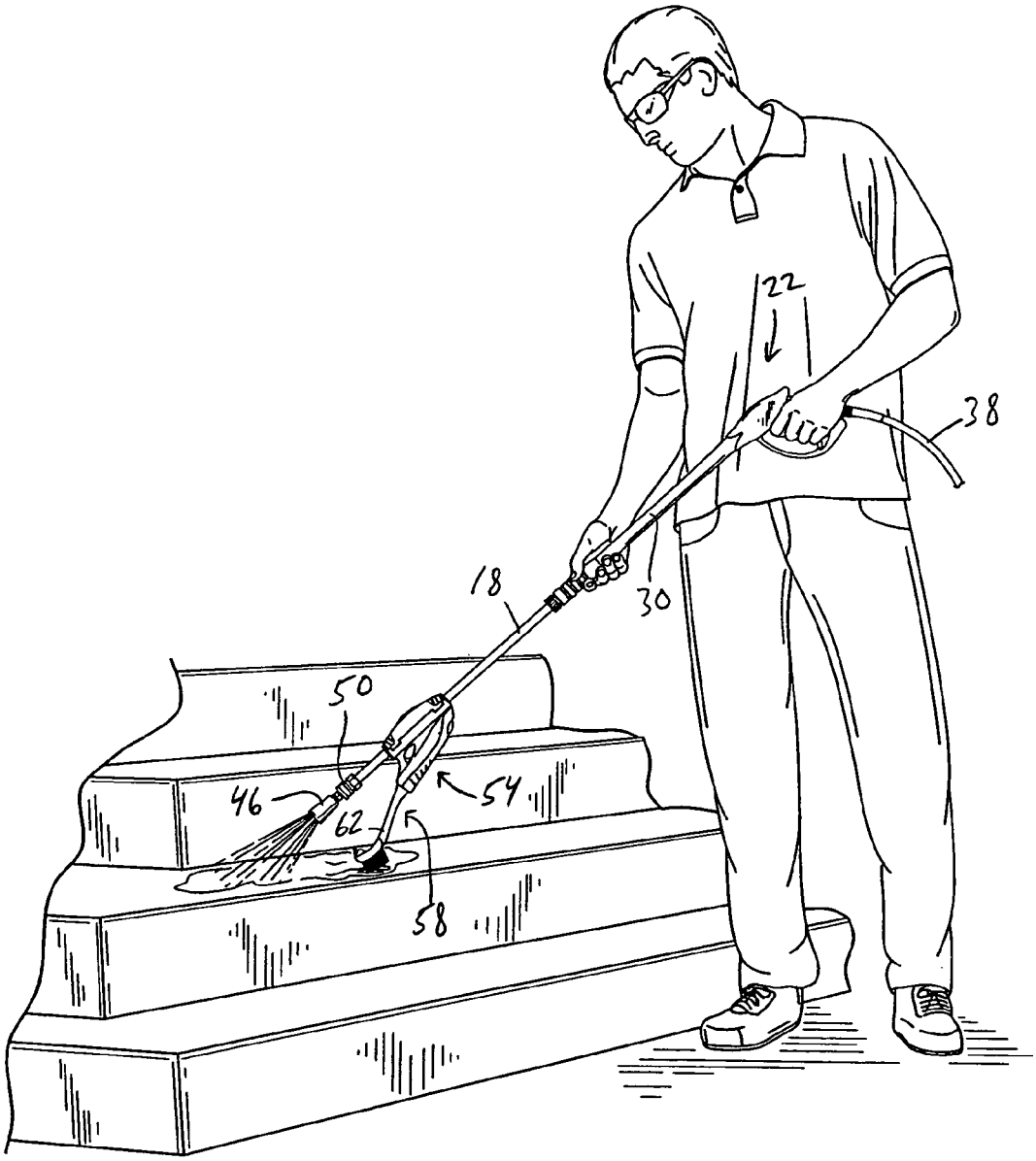
FIG. 2 is a front perspective view of an operator using the pressurized fluid delivery apparatus of FIG. 1.

With reference to FIGS. 1 and 2, an accessory mount 54 is coupled to the wand 18. The mount 54 couples an accessory 58, such as a two-sided brush 62, to the wand 18. With reference to FIG. 2, the mount 54 allows the operator to clean an area or a surface using the nozzle 46 and the accessory 58 simultaneously. In other words, the operator may clean an area or surface, such as the stairs illustrated in FIG. 2, using both the spray output by the nozzle 46 and the brush 62. In another manner of using the pressure washer 10, the operator may clean an area or surface initially using the brush 62 only, then rinse the area or surface using the spray output by the nozzle 46. In yet another manner of using the pressure washer 10, the operator may not use the accessory 58 to clean any of the area or surface. Using the pressure washer 10 in any of these manners, the operator would not have to put down the gun assembly 22 and wand 18 to pick up a separate accessory or tool, such as the brush 62, to clean an area or surface. Also, the operator will not need to remove the nozzle and then attach the accessory or tool in its place, as is necessary when the accessory or tool is aligned with the water output axis.

With continued reference to FIG. 2, the brush 62 is positioned "off-axis" of the spray discharged from the nozzle 46. By positioning the accessories 58, such as the brush 62, off-axis of the spray, the spray may directly impact the surface to be cleaned without a reduction of the effective pressure of the spray on the surface. Prior-art devices are typically co-axial with the spray or otherwise interfere with the spray before it impinges on a surface to be cleaned, therefore reducing the effective pressure of the spray on the surface and reducing the cleaning capability of the device.

Figure 3:
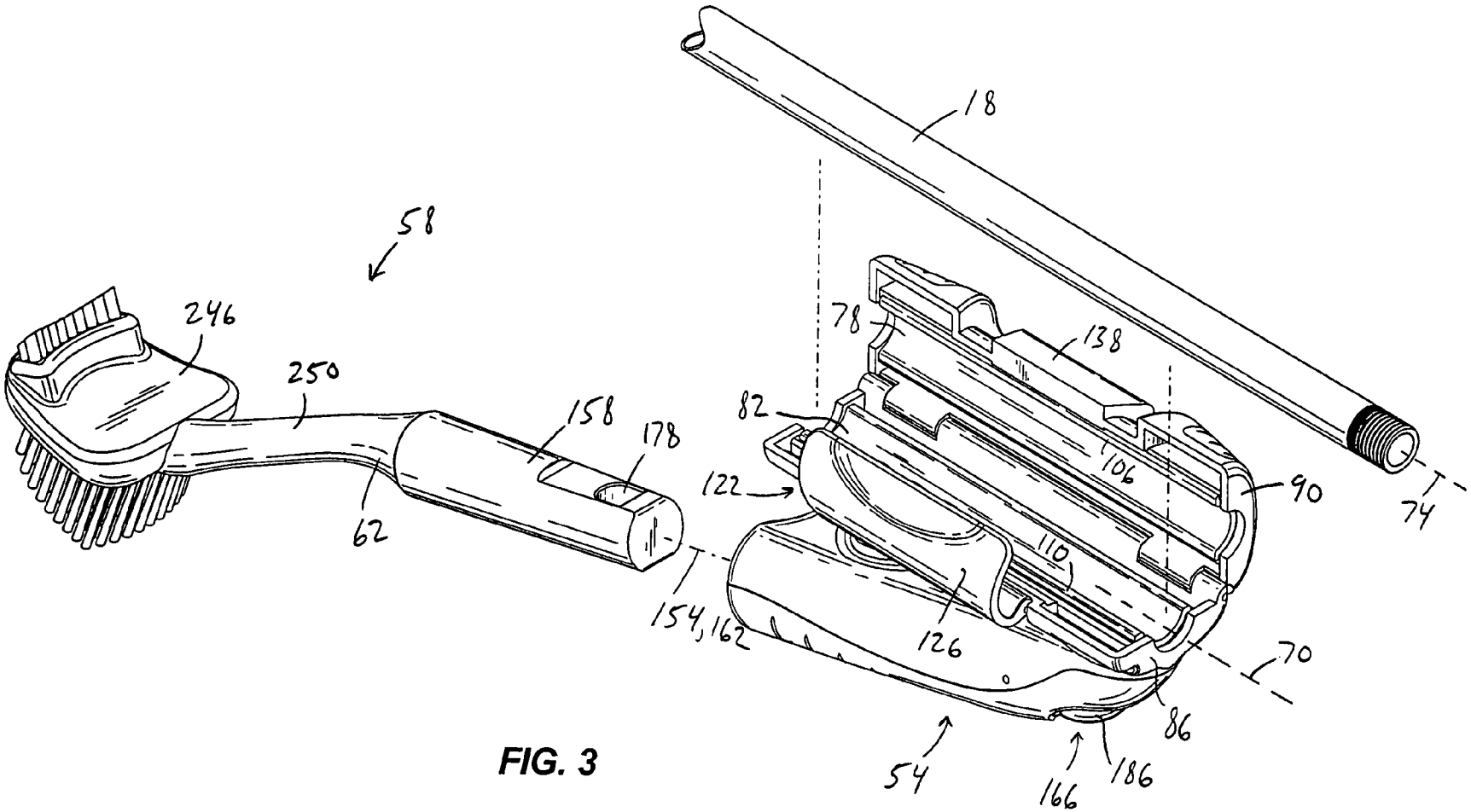
FIG. 3 is an enlarged, exploded perspective view of the gun assembly and wand of FIG. 1, illustrating the mount being removed from the wand and the accessory being removed from the mount.

With reference to FIG. 3, the mount 54 is shown removed from the wand 18. The mount 54 is coupled to the wand 18 by a first receiving portion 66 (see FIG. 5), which slidably engages the wand 18 along a central axis 70. The wand 18 also defines a central axis 74 along which the mount 54 may be slidable, and about which the mount 54 may be rotatable to a position determined by the operator. The respective axes 70, 74 of the mount 54 and the wand 18 are coaxial when the mount 54 is coupled to the wand 18.

In an alternative construction of the mount, the mount may be permanently connected to the wand 18 rather than being removably coupled to the wand 18, slidable with respect to the wand 18, or rotatable with respect to the wand 18. Particularly, the mount may be overmolded to the wand 18, such that the position of the mount and the attached accessory 58 relative to the wand 18 may not be adjusted by the operator of the pressure washer 10.

With reference to FIG. 3, the first receiving portion 66 includes a first surface 78, and a second surface 82 opposite the first surface 78. Upon coupling the mount 54 to the wand 18, the wand 18 is positioned between the first and second surfaces 78, 82. Particularly, the curvature of the first and second surfaces 78, 82 is substantially similar to the curvature of the wand 18, such that the wand 18 is engaged by a substantial portion of the first surface 78 and a substantial portion of the second surface 82 when the mount 54 is coupled to the wand 18. Alternatively, the first receiving portion 66 may be configured using any number of surfaces to engage the wand 18, including a single, continuous surface.

The mount 54 includes a bottom portion 86 and a top portion 90 movably coupled to the bottom portion 86. In the illustrated construction of the mount 54, pins 94 pivotably couple the top portion 90 to the bottom portion 86 (see FIG. 4). Alternatively, different structure may be used to couple the top portion 90 to the bottom portion 86 (e.g., a living hinge). Further, the top portion 90 may be removable from the bottom portion 86 entirely, and re-attached when coupling the mount 54 to the wand 18.

Figure 4:
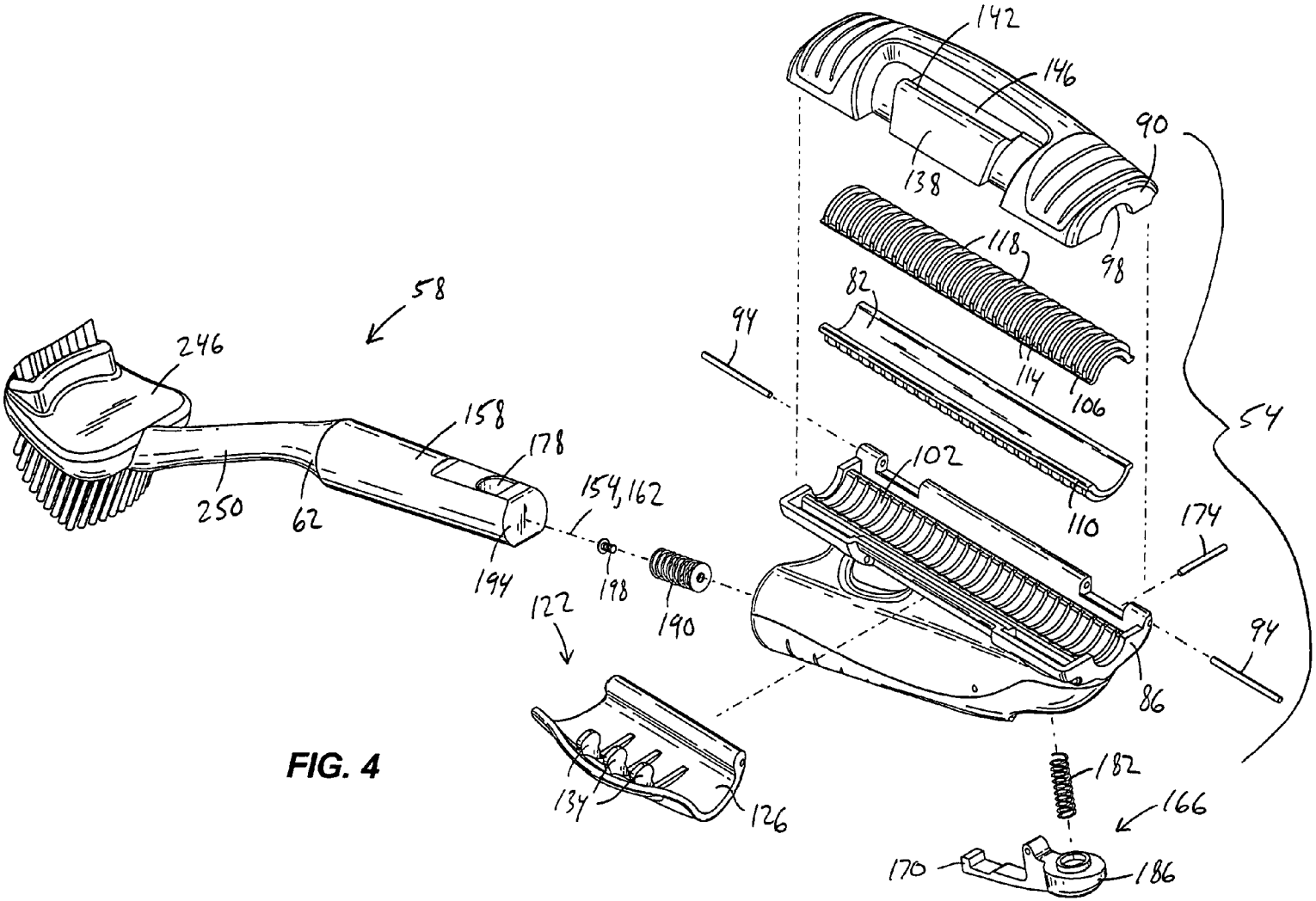
FIG. 4 is an enlarged, exploded perspective view of the mount of FIG. 1.

With continued reference to FIG. 4, the top and bottom portions 90, 86 of the mount 54 include respective channels 98, 102 in which curved or arcuate grips 106, 110 are positioned. The channels 98, 102 extend throughout the length of the first receiving portion 66 to allow the wand 18 to fit between the top and bottom portions 90, 86. The channels 98, 102 in the top and bottom portions 90, 86 include circumferential grooves 114, in which matching circumferential ribs 118 on the grips 106, 110 are received. The combination of the ribs 118 and the grooves 114 substantially axially constrains the grips 106, 110 relative to the top and bottom portions 90, 86.

The first and second surfaces 78, 82 are the facing surfaces of the respective grips 106, 110, and do not include any grooves 114 or ribs 118. Rather, the first and second surfaces 78, 82 are smooth to maximize the amount of surface area engageable with the wand 18. The grips 106, 110 may be made from a material that provides a high coefficient of friction on the first and second surfaces 78, 82. In the illustrated construction of the mount 54, the grips 106, 110 are separate and distinct components from the top portion 90 and the bottom portion 86. Adhesive may be used to secure the grips 106, 110 to the top and bottom portions 90, 86. Alternatively, the grips 106, 110 may be friction welded to the top and bottom portions 90, 86. As a further alternative. the grips 106, 110 may be molded into the top and bottom portions 90, 86, or the grips 106, 110 may be integrally formed with the top and bottom portions 90, 86.

With reference to FIGS. 3 and 4, the mount 54 includes a locking member 122 biasing the top portion 90 against the bottom portion 86. In the illustrated construction of the mount 54, the locking member 122 comprises a latch 126 pivotably coupled to the bottom portion 86. Like the connection between the top and bottom portions 90, 86, the latch 126 is pivotably coupled to the bottom portion 86 by a pin 130 (see FIG. 5). Alternatively, other structure may be used to couple the latch 126 to the bottom portion 86 (e.g., a living hinge). Further, the locking member 122 may comprise any of a number of different clamping devices to secure together the top and bottom portions 90, 86 to retain the mount 54 to the wand 18.

With reference to FIG. 4, the latch 126 includes a plurality of inwardly-extending rounded projections 134 configured to engage a ramp surface 138 formed on the top portion 90. The ramp surface 138 defines an apex 142 and a groove 146 adjacent the apex 142. Upon positioning the wand 18 between the top and bottom portions 90, 86 and pivoting the top portion 90 downwardly to enclose the wand 18, the latch 126 is pivoted toward the top portion 90 until the projections 134 engage the ramp surface 138 at a location below the apex 142 of the ramp surface 138. To secure the top portion 90 to the bottom portion 86, additional force applied to the latch 126 causes the latch 126 to deform, or "stretch" to allow the projections 134 to pass over the apex 142. Once the projections 134 pass over the apex 142, the latch 126 resumes its natural or un-deformed shape, and the projections 134 quickly snap into the groove 146 adjacent the apex 142.

To remove the mount 54 from the wand 18, the latch 126 is stretched to allow the projections 134 to pass over the apex 142 of the ramp surface 138. Once the projections 134 pass over the apex 142, the latch 126 springs back to its un-deformed shape. The latch 126 may then be pivoted away from the top portion 90 to allow the top portion 90 to pivot with respect to the bottom portion 86 so that the wand 18 can be removed. Such an "over-center" latch configuration provides a sufficient clamping force between the top and bottom portions 90, 86 to axially secure the mount 54 to the wand 18. Alternatively, other locking members may be used to bias the top portion 90 against the bottom portion 86.

Figure 5:
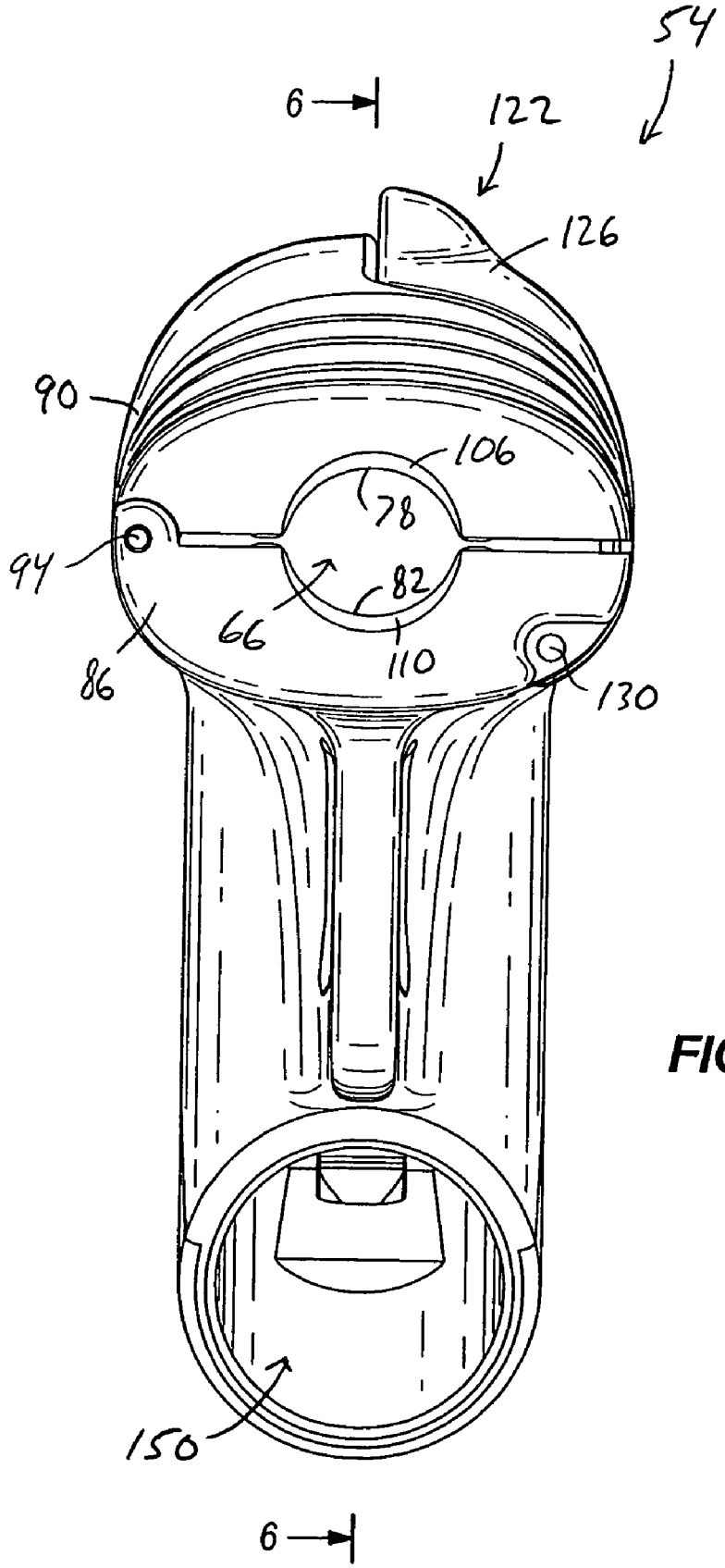
FIG. 5 is an enlarged, end view of the mount of FIG. 1.
Figure 6:
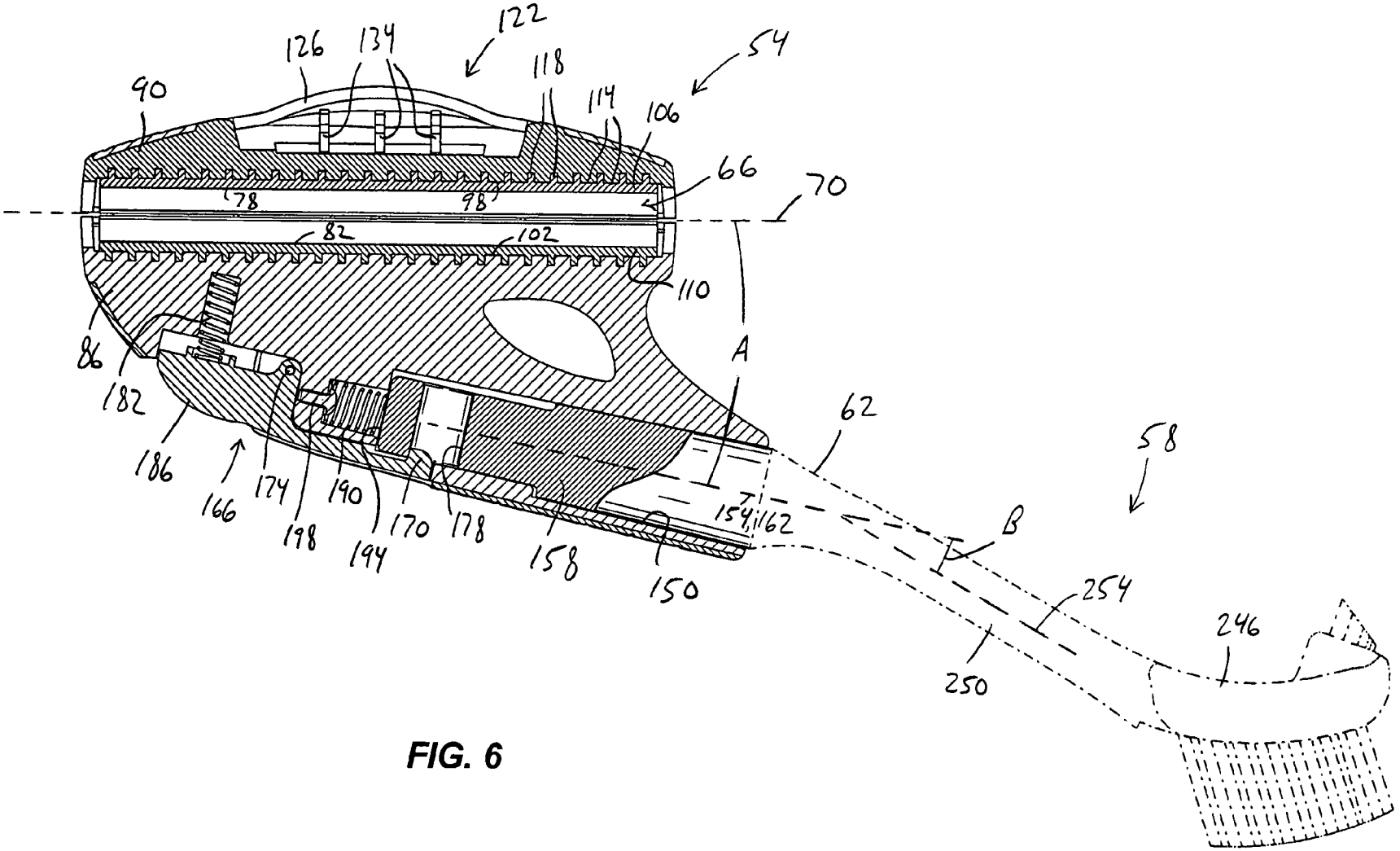
FIG. 6 is a cross-sectional view of the mount of FIG. 1 through section 6-6 in FIG. 5, illustrating the accessory secured to the mount.
Figure 7:
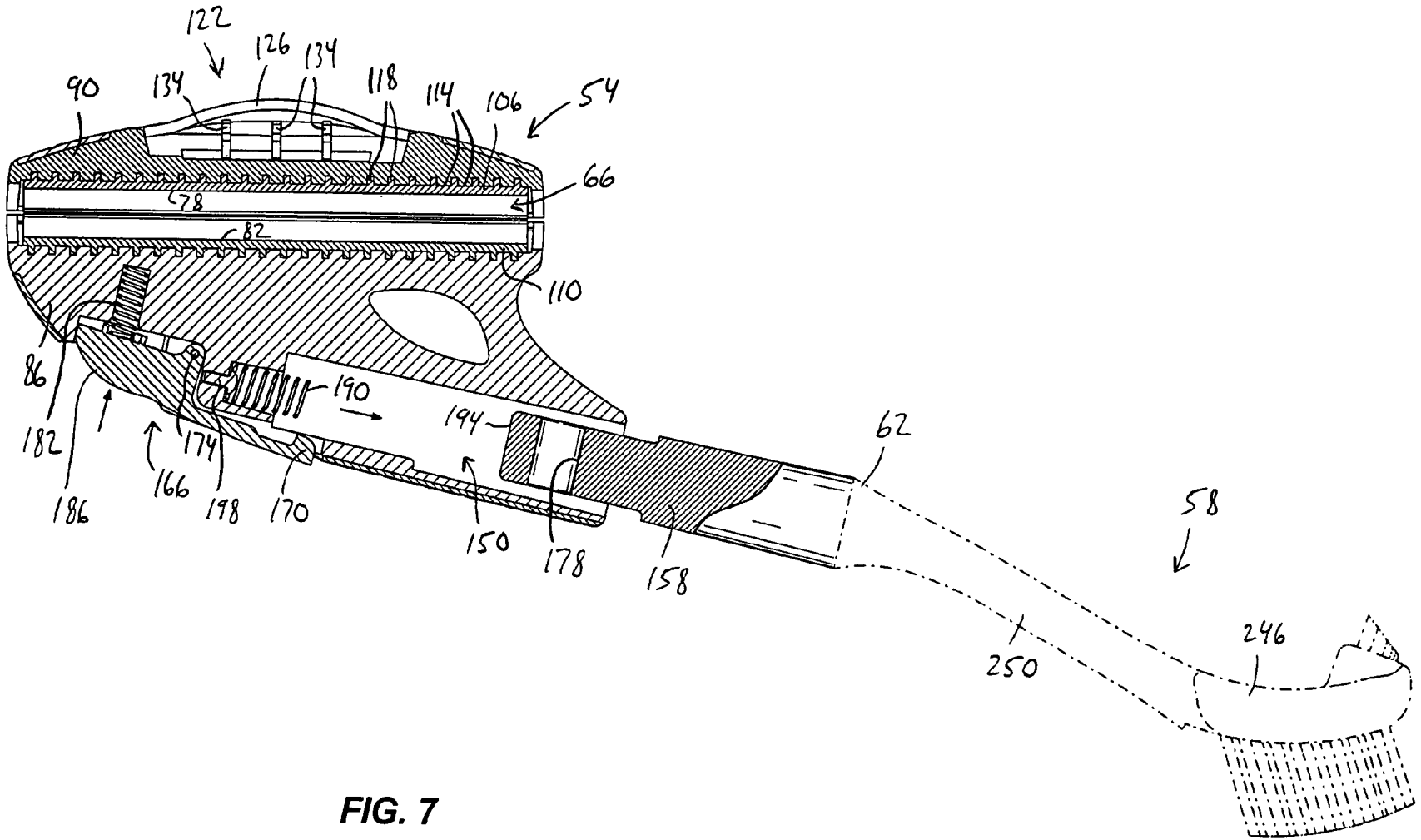
FIG. 7 is a cross-sectional view of the mount of FIG. 1 through section 7-7 in FIG. 5, illustrating the accessory being released and removed from the mount.

With reference to FIGS. 5-7, the mount 54 includes a second receiving portion 150 defining a central axis 154 disposed at an acute angle with respect to the axes 70, 74 of the first receiving portion 66 and the wand 18. In the illustrated construction of the mount 54, the central axis 154 of the second receiving portion 150 is disposed at an angle A of about 12 degrees with respect to the axes 70, 74 of the first receiving portion 66 and the wand 18 (see FIG. 6). However, in alternate constructions of the mount 54, the central axis 154 of the second receiving portion 150 may be disposed at an angle A more or less than about 12 degrees with respect to the axes 70, 74 of the first receiving portion 66 and the wand 18.

Figure 21:
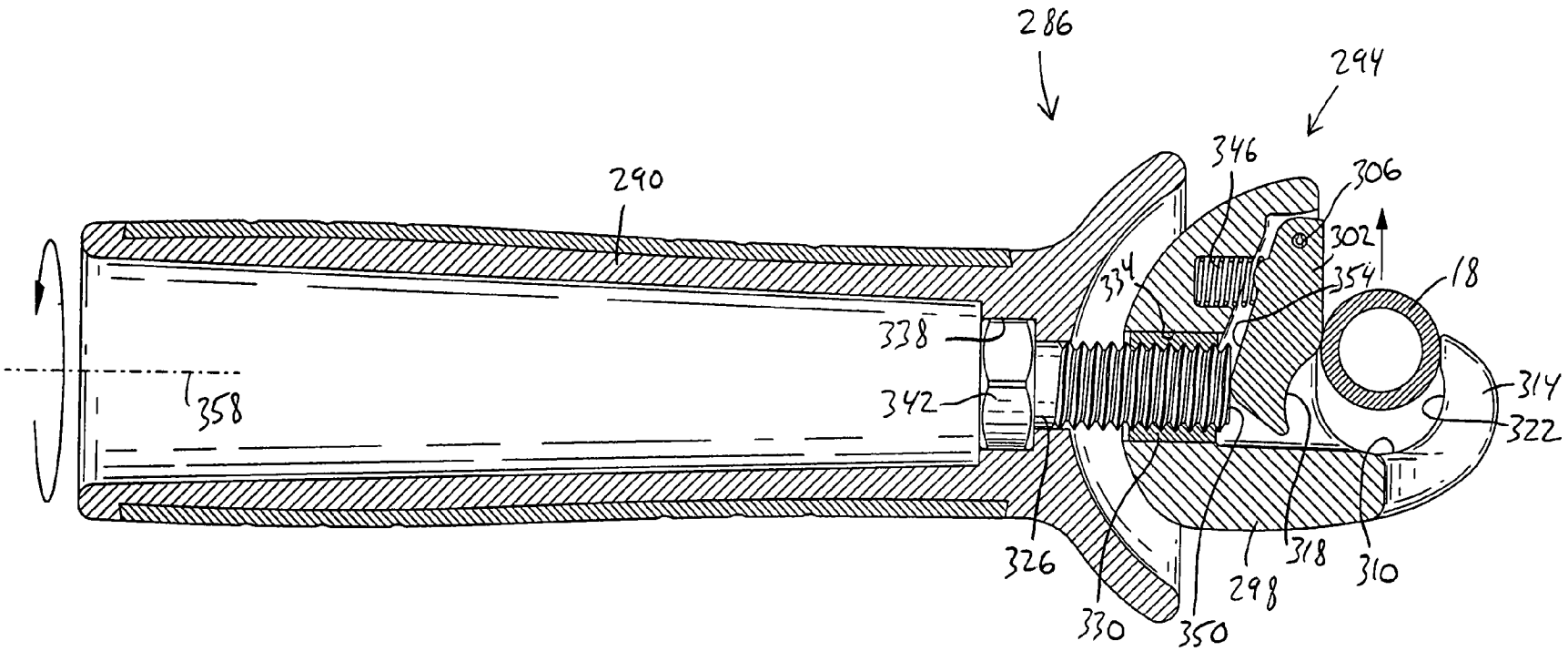
FIG. 21 is a cross-sectional view of the handle assembly of FIG. 18 through section 21-21 in FIG. 18, illustrating the handle assembly being released and removed from the wand.

With reference to FIG. 21, a second construction of the mount 54*a* is shown. The mount 54*a* is substantially similar to the mount 54 in FIGS. 1-9, however, the second receiving portion 150*a* of the mount 54*a* is movably coupled to the first receiving portion 66*a*, such that the orientation of the second receiving portion 150*a* may vary with respect to the first receiving portion 66*a*. Particularly, the angle C between the central axis 154 of the second receiving portion 150*a* and the axes 70, 74 of the first receiving portion 66*a* and the wand 18 may be adjusted within a range of about 80 degrees. Therefore, the angle of the accessory 58 may be adjusted relative to the wand 18. In the illustrated construction of the mount 54*a*, the second receiving portion 150*a* is pivotably coupled to the first receiving portion 66*a* via a locking pivot 55, although a fixed angle could be used. Any of a number of different locking members or clamping devices may be used to retain the second receiving portion 150*a* in a particular orientation with respect to the first receiving portion 66*a*.

With reference to FIGS. 3, 4, 6, and 7, the accessory 58, such as the illustrated brush 62, is coupled to the wand 18 via the second receiving portion 150 in the mount 54. The accessory 58 includes an insertion portion 158 having a generally conical shape and defining a central axis 162. With reference to FIGS. 6 and 7, the second receiving portion 150 also includes a generally conical shape similar to that of the insertion portion 158. The matching shapes of the insertion portion 158 of the accessory 58 and the second receiving portion 150 provide a snug fit to the insertion portion 158 in the second receiving portion 150. Further, the respective axes 162, 154 of the insertion portion 158 and the second receiving portion 150 are aligned upon coupling the accessory 58 to the mount 54.

With continued reference to FIGS. 6 and 7, the mount 54 includes a locking member 166 configured to secure the accessory 58 to the mount 54. In the illustrated construction of the mount 54, the locking member 166 comprises a finger 170 pivotably coupled to the bottom portion 86 by a pin 174 (see also FIG. 4). The finger 170 may be pivoted between a locking position, in which the finger 170 extends into the second receiving portion 150 and engages a slot 178 in the insertion portion 158 to secure the accessory 58 in the second receiving portion 150, and a releasing position, in which the finger 170 disengages the slot 178 to release the accessory 58 so it can be removed from the second receiving portion 150. FIG. 6 illustrates the finger 170 in the locking position, which, due to a spring 182 biasing the finger 170, is the default position of the finger 170. To disengage the finger 170 from the slot 178 in the insertion portion 158, the operator may depress a button 186 on the locking member 166 to pivot the finger 170, against the bias of the spring 182, toward the releasing position shown in FIG. 7.

With reference to FIGS. 4, 6, and 7, a spring 190 is positioned in the second receiving portion 150 along the central axis 154 to abut an end 194 of the insertion portion 158. A fastener 198 secures the spring 190 within the second receiving portion 150. As shown in FIG. 6, the spring 190 is compressed by the insertion portion 158 when the accessory 58 is locked to the mount 54. When the operator depresses the button 186, the finger 170 disengages the slot 178 in the insertion portion 158 to release the accessory 58. After the accessory 58 is released, the spring 190 decompresses to at least partially push the insertion portion 158 out of the receiving portion 150 (see FIG. 7).

Figure 8:
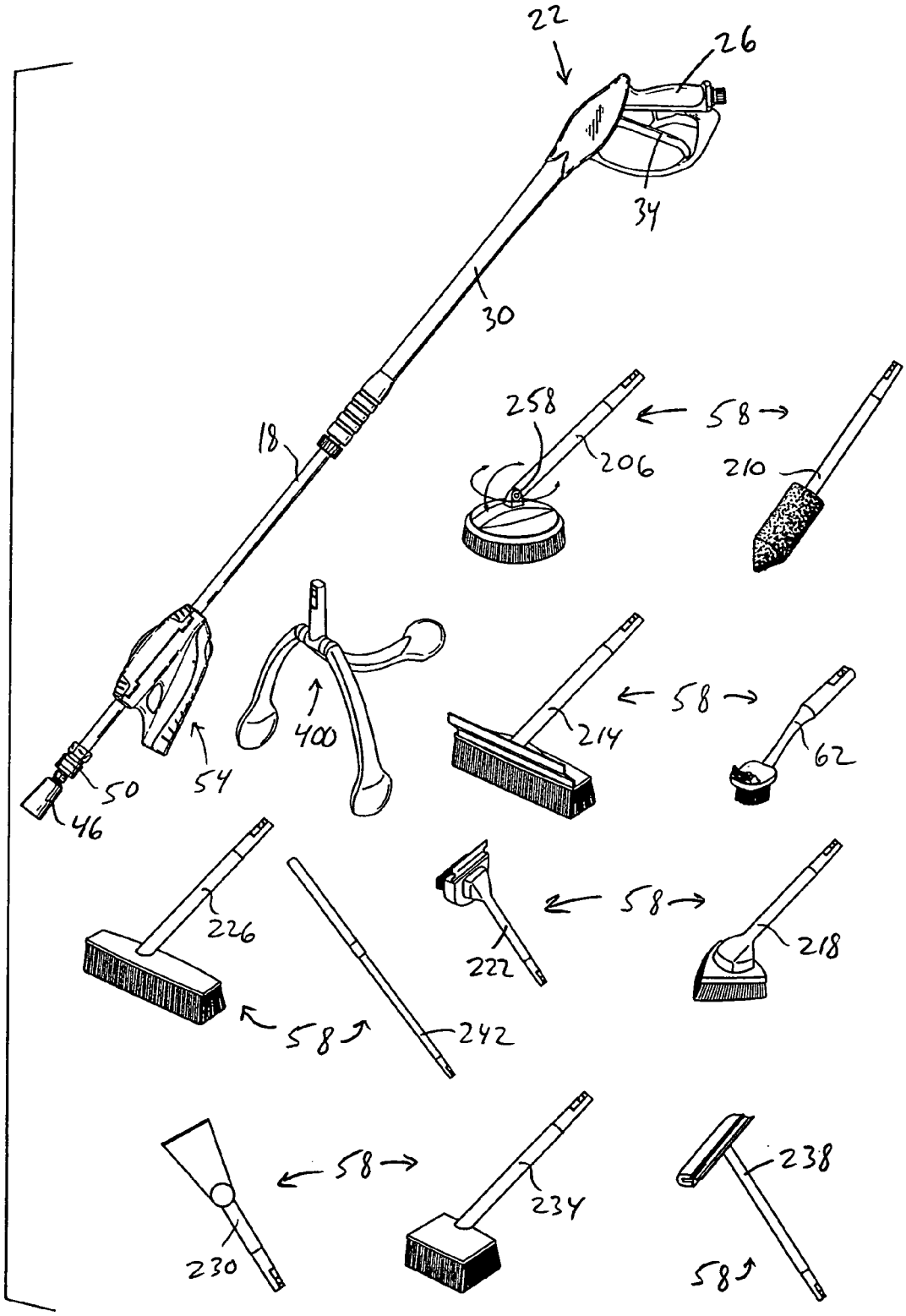
FIG. 8 is a side view of the wand and mount of FIG. 1, illustrating different accessories that may be attached to the mount.

With reference to FIG. 8, the mount 54 can be used to couple a variety of accessories 58 to the wand 18, in addition to the two-sided brush 62 shown in FIGS. 1-4, 6, and 7. Particularly, such accessories 58 may include: a wash mitt 206 including a swivel head, a conical brush 210, a body brush and squeegee 214, a corner and spot brush 218, a wire brush and blade 222, a deck brush 226, a scraper blade 230, a sliding brush 234, a window scrub and squeegee 238, and a telescoping pole or extension 242. Another accessory which may be coupled to the mount 54 may include a roller assembly or a roller accessory 400, which is described in more detail below.

The accessories 58 illustrated in FIG. 8 include a head portion, an insertion portion similar to that of the two-sided brush 62 shown in FIGS. 1-4, 6, and 7 to enable the accessory 58 to be secured to the mount 54, and a handle portion coupling the head portion and the insertion portion. Some of the accessories 58 may include handle portions that are not coaxial with the insertion portions of the accessories 58. As a result, the effective angle between the accessory 58 and the mount 54 may deviate from the angle A between the respective axes 70, 154 of the first and second receiving portions 66, 150 (see FIG. 6). Particularly, the two-sided brush 62 shown in FIGS. 1-4, 6, and 7 includes a head portion 246 and a handle portion 250 coupling the head portion 246 and the insertion portion 158. The handle portion 250 defines a central axis 254 that is not aligned with the central axis 162 of the insertion portion 158. In the illustrated construction of the brush 62, the respective axes 254, 162 of the handle portion 250 and the insertion portion 158 define therebetween an angle B of about 15 degrees. As such, the total angle between the handle portion 250 and the wand 18 is equal to angle A plus angle B, or about 27 degrees in the illustrated brush 62. However, in alternate constructions of the brush 62 or any of the accessories 58 illustrated in FIG. 8, the respective axes 254, 162 of the handle portion 250 and the insertion portion 158 may be disposed at an angle B more or less than about 15 degrees.

With reference to FIG. 8, rather than providing the individual accessories 58 with handle portions and insertion portions, the telescoping pole or extension 242 may alternatively be used in combination with "head portions" of the accessories 58. In other words, the telescoping pole or extension 242 may connect to the second receiving portion 150 of the mount 54 as described above with reference to the brush 62. The free end of the telescoping pole or extension 242 and the "head portions" of the accessories 58 may therefore include mating connecting structure to secure the "head portions" of the accessories 58 to the free end of the telescoping pole or extension 242.

With continued reference to FIG. 8, one or more of the accessories 58 may include a swivel 258 coupling the handle portion to a head portion of the accessory 58. For example, the wash mitt 206 includes a swivel 258 coupling the head portion to the handle portion. The swivel 258 may allow the head portion to be oriented in any of a number of different angles with respect to the wand 18.

Figure 9:
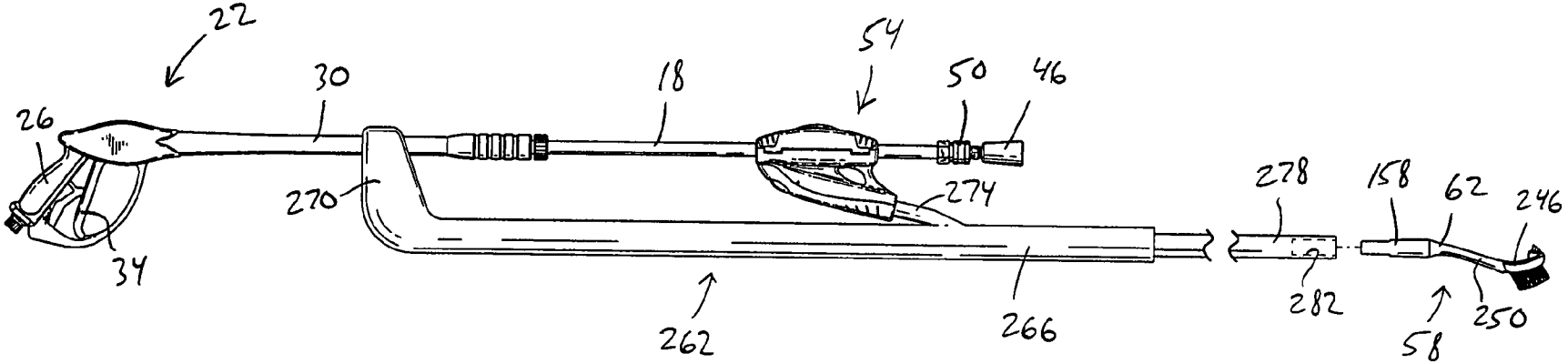
FIG. 9 is a side view of the gun assembly, wand, and mount of FIG. 1, illustrating an extension coupled to the gun assembly and the mount.

FIG. 9 illustrates yet another accessory 262 that may be coupled to the wand 18 via the mount 54. The accessory 262 includes an extension 266 having a first mounting portion 270, a second mounting portion 274 spaced from the first mounting portion 270, and a free end 278 spaced from the first and second mounting portions 270, 278. The first mounting portion 270 may be coupled to at least one of the barrel 30 of the gun assembly 22 and the wand 18. By coupling the first mounting portion 270 at least partially to the barrel 30 of the gun assembly 22, less of the extension's weight is supported directly by the wand 18. FIG. 9 illustrates the first mounting portion 270 only coupled to the barrel 30 of the gun assembly 22, further reducing the amount of the extension's weight supported by the wand 18.

FIG. 9 also schematically illustrates the second mounting portion 274 of the extension 266 coupled to the second receiving portion 150 of the mount 54. The second mounting portion 274 may include an insertion portion, similar to that shown on the brush 62 in FIGS. 3 and 4, to couple to the second receiving portion 150 of the mount 54 like the brush 62 and any of the other accessories 58 shown in FIG. 8. Further, FIG. 9 schematically illustrates the free end 278 having a receiving portion 282 substantially similar to the second receiving portion 150 of the mount 54. As such, the brush 62, or any of the other accessories 58 shown in FIG. 8, may be coupled to the free end 278 of the extension 266 in the manner described above with respect to the insertion portion 158 of the brush 62 and the second receiving portion 150 of the mount 54. In one construction of the extension 266, the extension 266 may have a length between about 10 feet and about 15 feet. However, other constructions of the extension 266 may have lengths less than about 10 feet or lengths more than about 15 feet.

Figure 10:
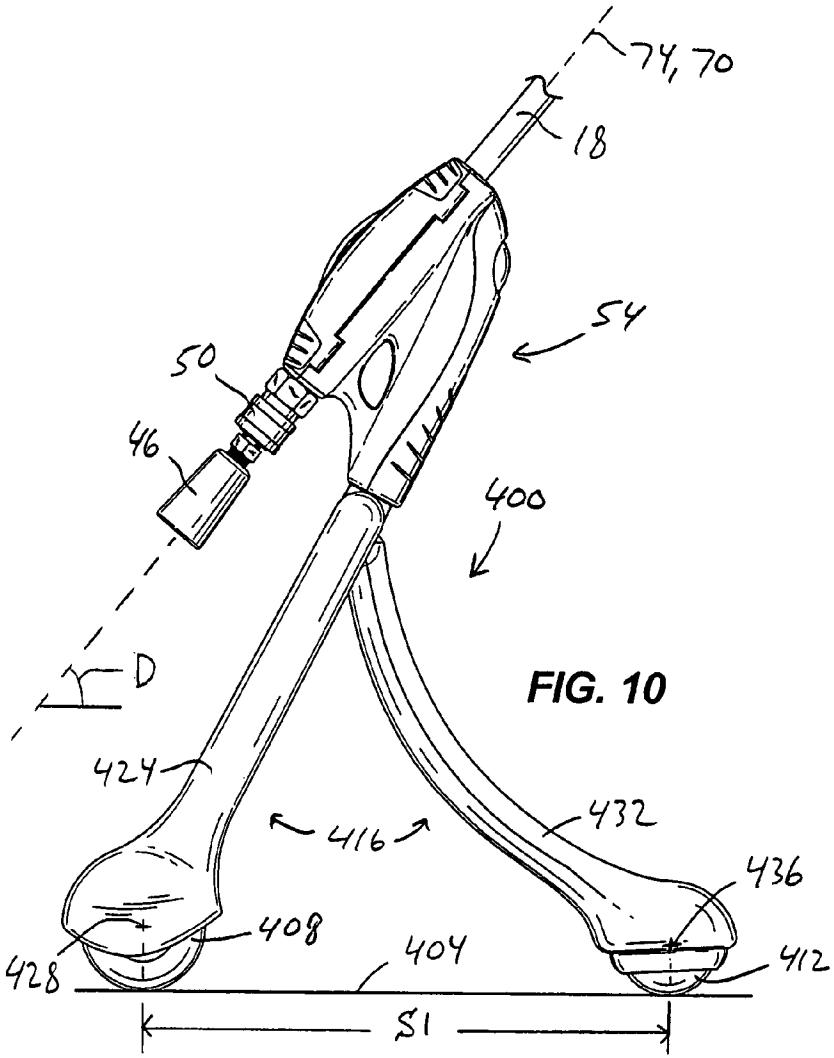
FIG. 10 is a side view of a portion of the wand and mount of FIG. 1, illustrating a roller accessory that may be attached to the mount.
Figure 11:
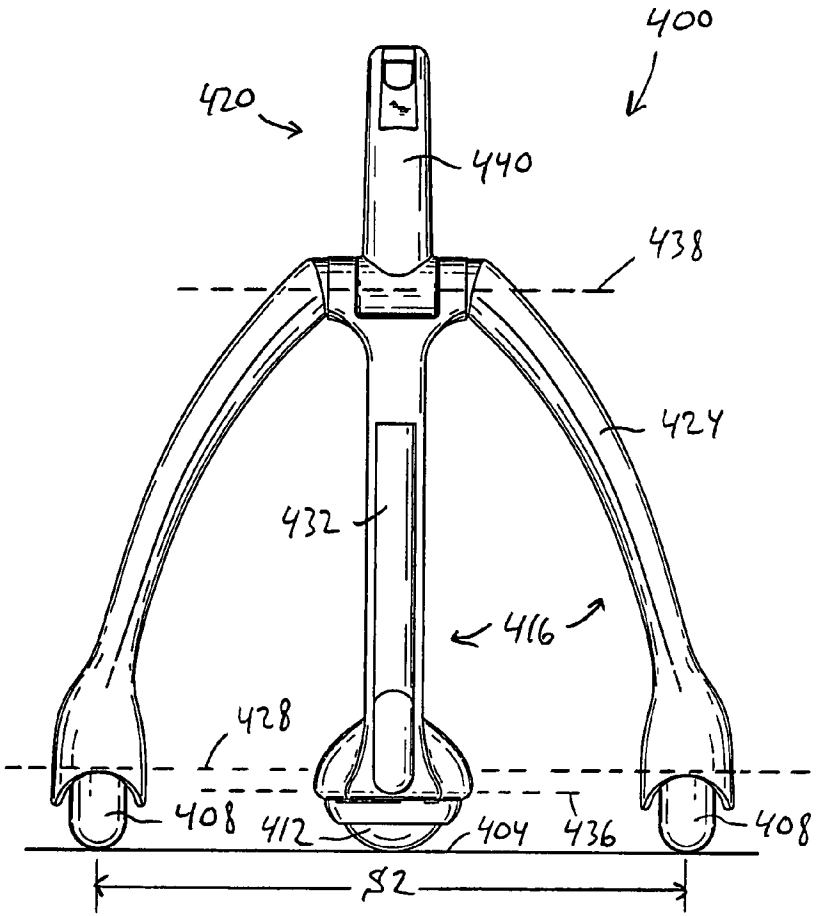
FIG. 11 is a front view of the roller accessory of FIG. 10.
Figure 12:
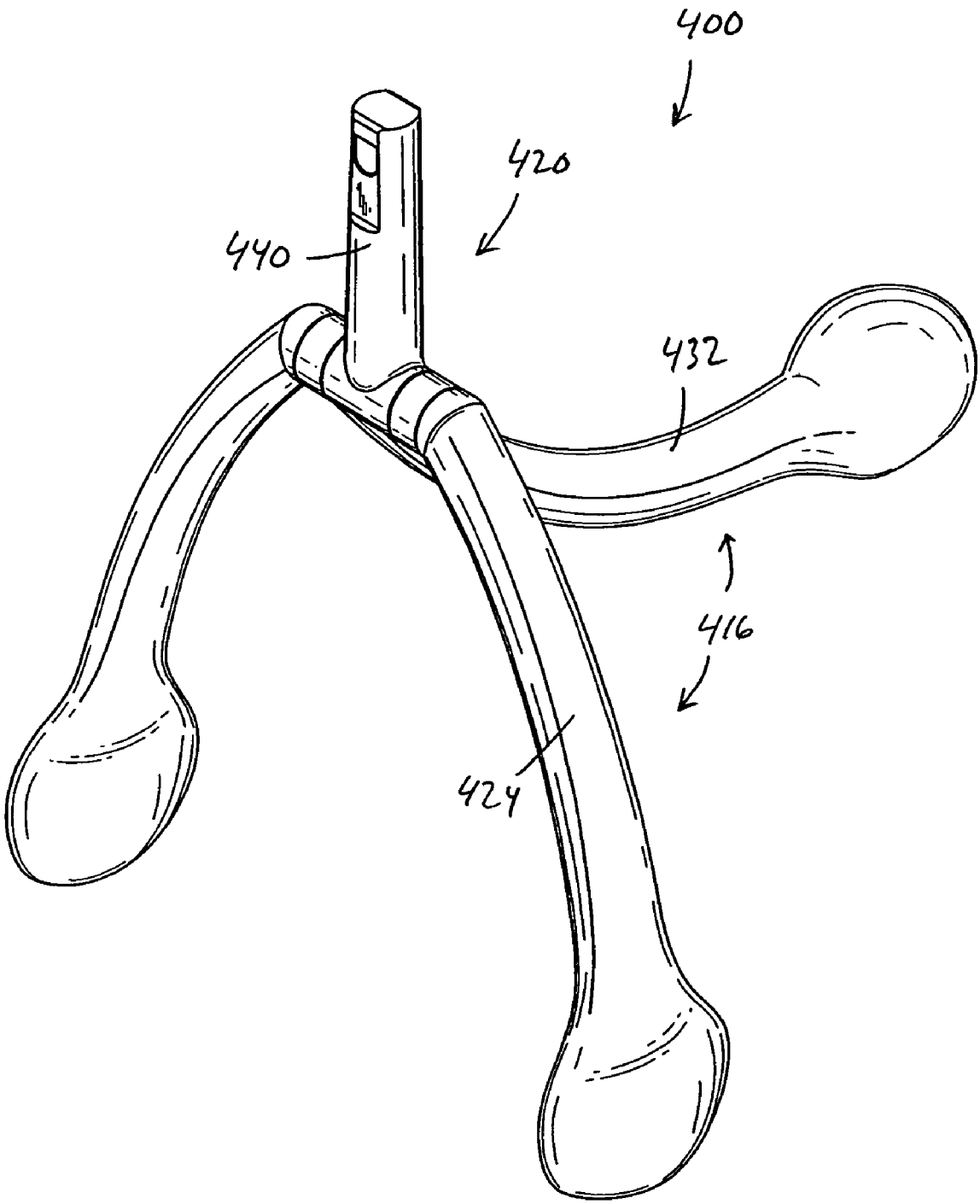
FIG. 12 is a front perspective view of the roller accessory of FIG. 10.
Figure 13:
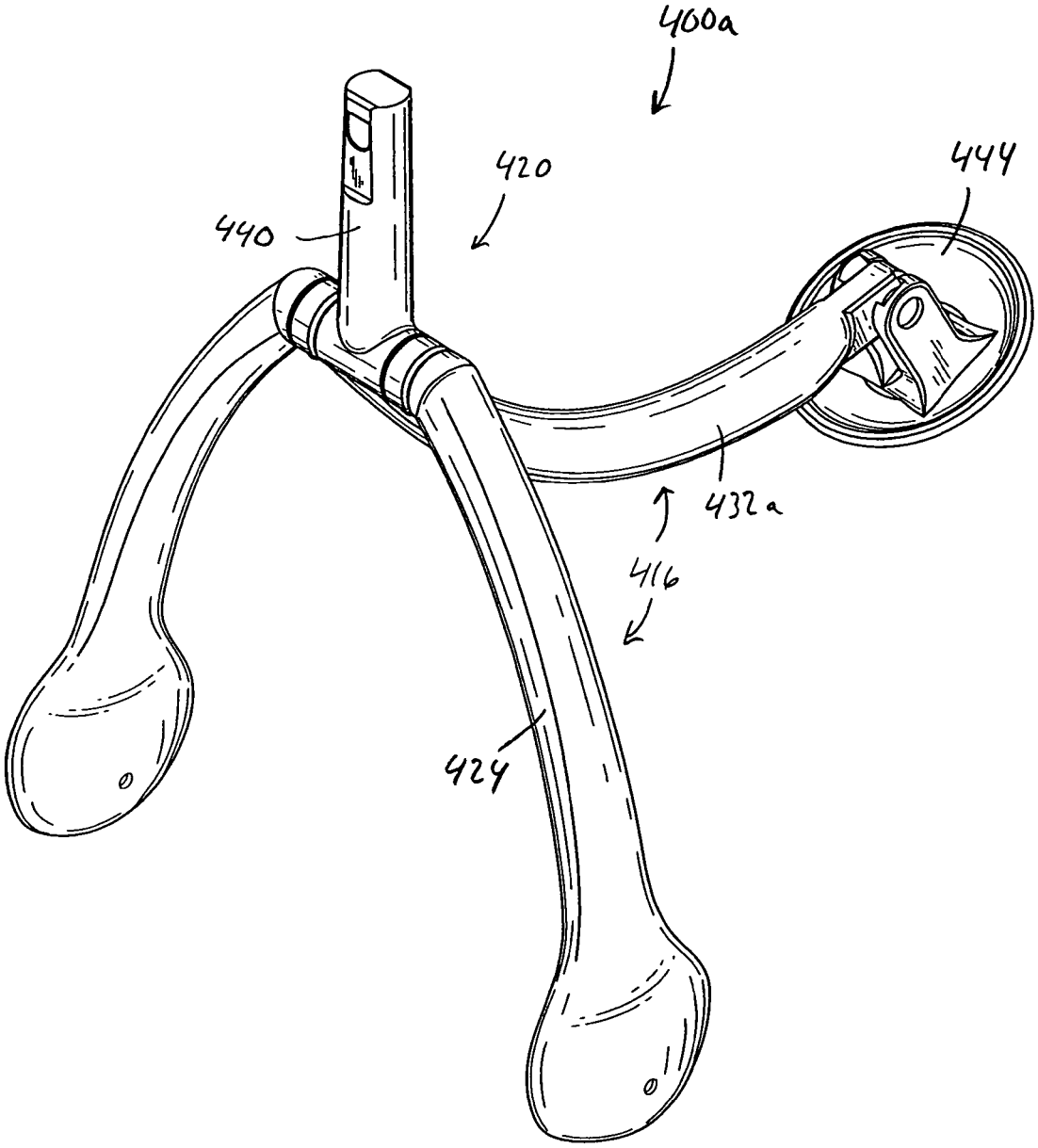
FIG. 13 is a front perspective view of a second construction of the roller accessory that may be attached to the mount of FIG. 1.
Figure 14:
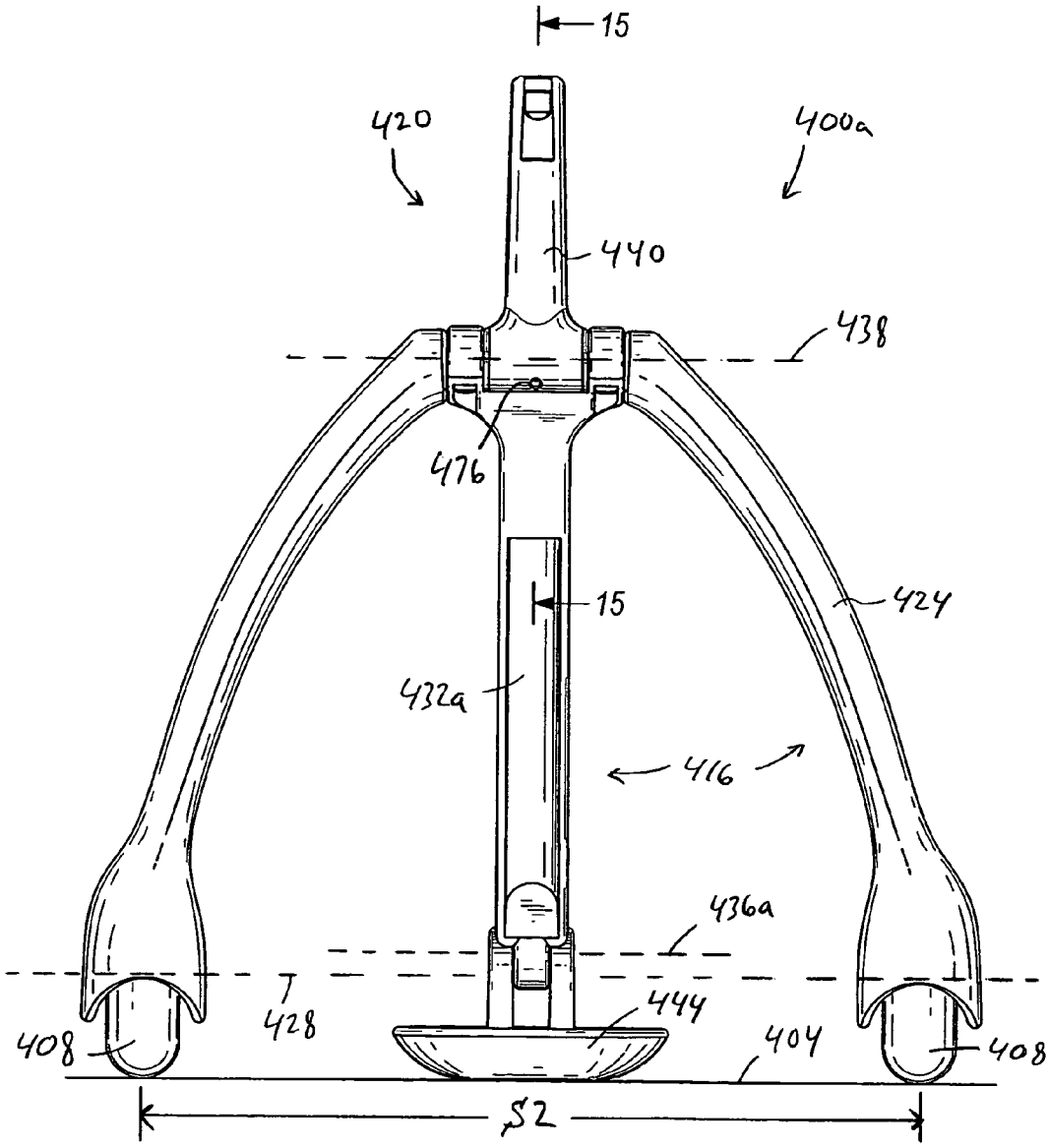
FIG. 14 is a front view of the roller accessory of FIG. 13.

FIGS. 10-12 illustrate the roller accessory 400, which may be coupled to the mount 54 to space the nozzle 46 a fixed distance from a support surface 404 as the gun assembly 22 is traversed across the support surface 404. The roller accessory 400 includes two rollers 408 and a guide member in the form of a third roller 412 coupled by a frame 416 and a connector 420 extending from the frame 416. In the illustrated construction of the roller accessory 400, the frame 416 includes a first portion 424 coupling two of the rollers 408 which are aligned on a common, substantially horizontal roller axis 428, and a second portion 432 movably coupled to the first portion 424 (see FIGS. 10 and 11). The second portion 432 is also coupled to the third roller 412, which defines a roller axis 436 spaced from the roller axis 428. The second portion 432 may be moved or pivoted with respect to the first portion 424 about a pivot axis 438 (see FIG. 11) to increase or decrease the spacing between the respective axes 428, 436 of the rollers 408, 412, which, as a result, changes the angle "D" of the wand 18 with respect to the support surface 404 (see FIG. 10).

In the illustrated construction of the roller accessory 400, the second portion 432 may be moved or pivoted with respect to the first portion 424 to space the respective axes 428, 436 of the rollers 408, 412 by a dimension "S1" of at least about 8 inches (see FIG. 10). Further, the rollers 408 may be spaced from each other along the roller axis 428 by a dimension "S2" of at least about 8 inches (see FIG. 11). The spacing dimensions S1, S2 provide sufficient stability to the gun assembly 22, and particularly the nozzle 46, as the gun assembly 22 is traversed across the support surface 404. However, alternative constructions of the roller accessory 400 may utilize a dimension S1 greater than about 8 inches and a dimension S2 greater than about 8 inches to provide increased stability to the gun assembly 22 and the nozzle 46.

With reference to FIG. 10, as the second portion 432 is pivoted away from the first portion 424, the spacing dimension S1 is increased, and the angle D of the wand 18 with respect to the support surface 404 decreases. Further, as the angle D decreases, the spray discharged from the nozzle 46 impacts the support surface 404 at a location farther from the roller axis 428. Likewise, as the angle D increases, the spray discharged from the nozzle 46 impacts the support surface 404 at a location closer to the roller axis 428. The frame 416 is configured, however, such that the minimum spacing dimension S1 does not permit the angle D to be increased to the extent that the spray discharged from the nozzle 46 substantially intersects the roller axis 428. Such a configuration of the frame 416 is undesirable because the spray might impact the frame 416 or the rollers 408, potentially preventing the spray from impacting and cleaning the support surface 404.

Although not shown in the drawings, the second portion 432 of the frame 416 may also be moved or pivoted with respect to the first portion 424 of the frame 416 to "collapse" the frame 416 for storage. In other words, the second portion 432 of the frame 416 may be pivoted to a location substantially between the two rollers 408 to reduce the profile of the frame 416, and therefore reduce the amount of storage space occupied by the frame 416.

With reference to FIGS. 10 and 11, in the illustrated construction of the roller accessory 400, the two rollers 408 are configured as wheels having a single degree of freedom. The rollers 408 may only rotate about the roller axis 428 while the roller accessory 400, with the connected gun assembly 22, is traversed across the support surface 404. Also, in the illustrated construction of the roller accessory 400, the single roller 412 is configured as a spherical caster having multiple degrees of freedom. In other words, the single roller 412 may rotate about the roller axis 436, in addition to several other roller axes passing through the single roller 412. Such a configuration permits the roller accessory 400 to corner or turn, in addition to going straight, while traversing the support surface 404. In alternate construction, roller 412 could have a single horizontal axis but spin about a vertical axis. In an alternative construction of the roller accessory 400, the two rollers 408 may also be configured as spherical casters to permit the roller accessory 400 to move laterally on the support surface 404, in addition to moving forward, moving backward, and turning on the support surface 404.

Figure 15:
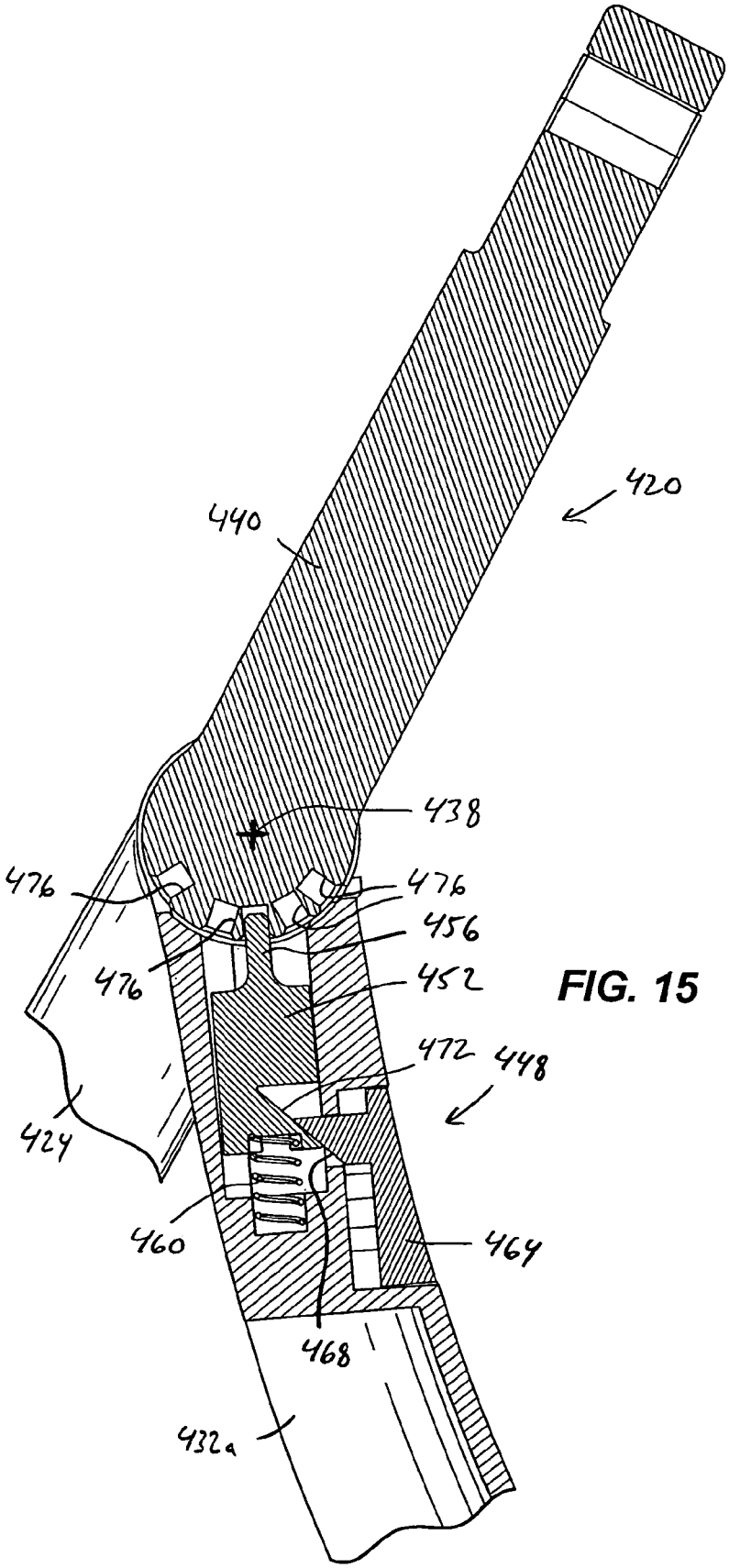
FIG. 15 is an enlarged cross-sectional view of the roller accessory of FIG. 13 through section 15-15 in FIG. 14, illustrating a mechanism for locking the roller accessory in a selected position.
Figure 16:
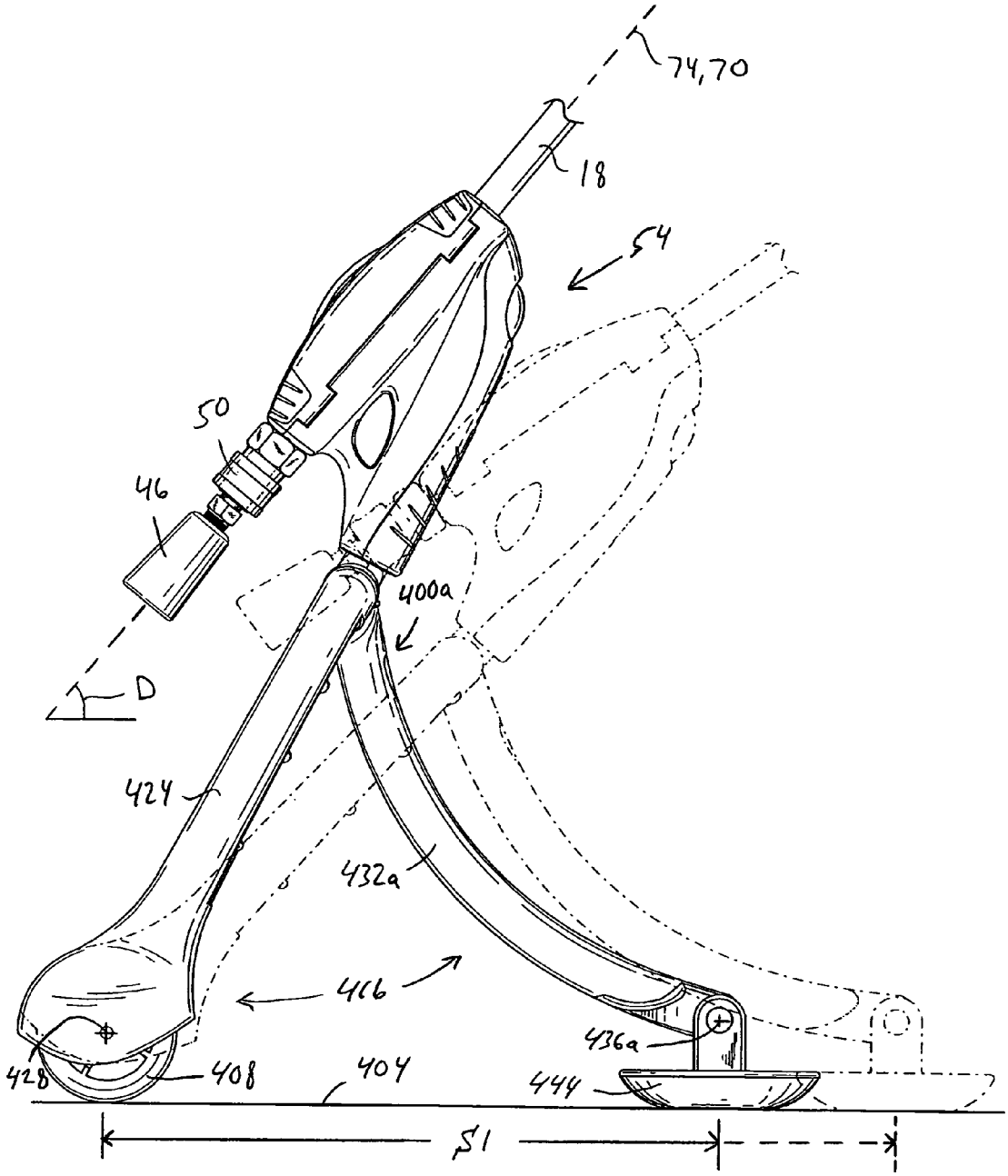
FIG. 16 is an enlarged side view of the wand and mount of FIG. 1, illustrating the roller accessory of FIG. 13 attached to the mount and being adjusted from a first position to a second position.
Figure 17:
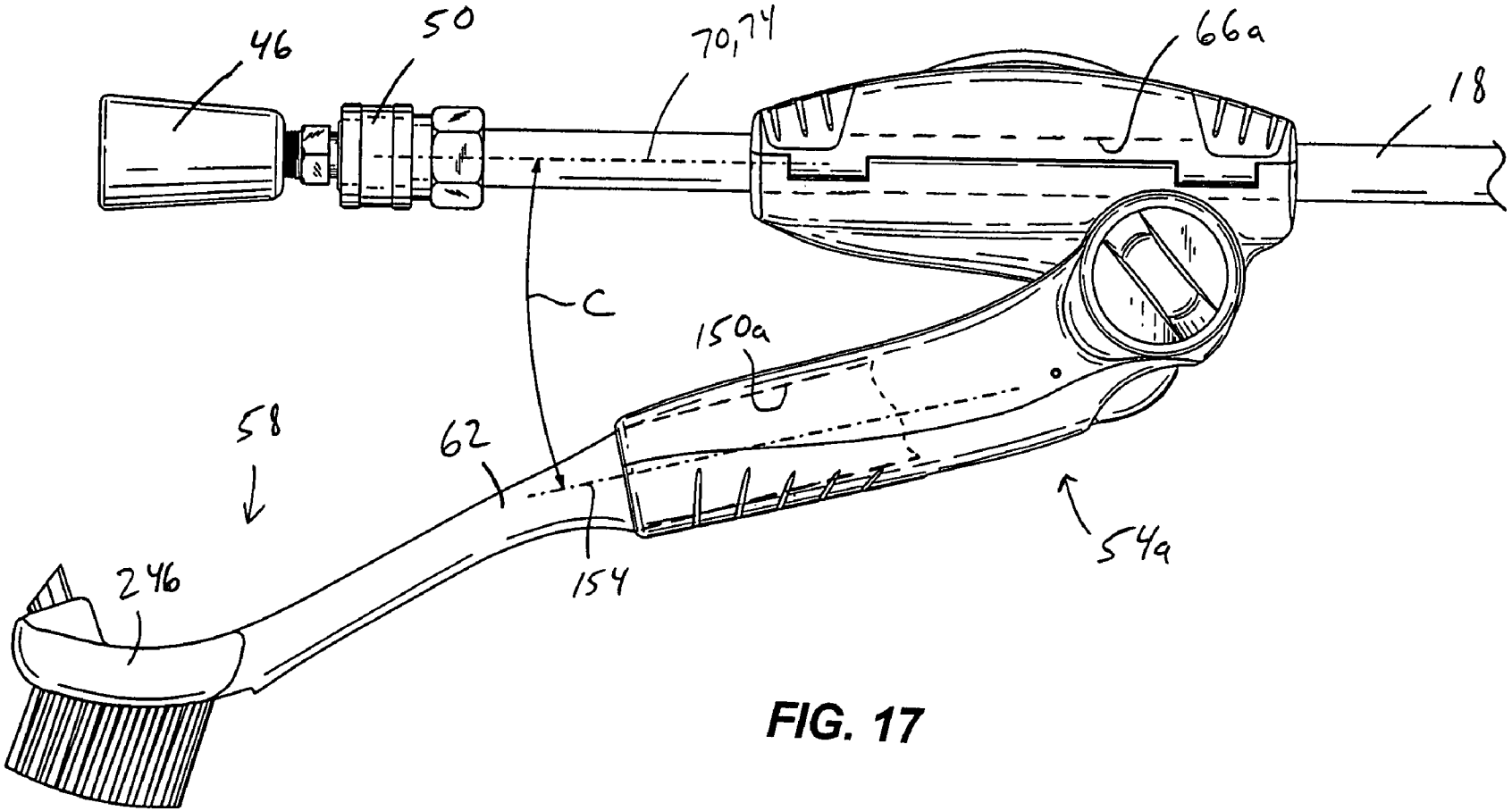
FIG. 17 is an enlarged side view of a second construction of the mount of FIG. 1.

With reference to FIGS. 13-16, a second construction of the roller accessory 400*a* is shown, with like components having like reference numerals. The roller accessory 400*a* is substantially similar to the roller accessory 400 illustrated in FIGS. 10-12, however, the roller accessory 400*a* includes a second portion 432*a* having a guide member configured as a substantially flat guide pad 444 rather than the single roller 412 configured as a spherical caster. With reference to FIG. 16, the guide pad 444 is pivotably coupled to the second portion 432*a* to compensate for the adjustable movement of the second portion 432*a* relative to the first portion 424 to vary the spacing dimension S1 and the angle D, as described above. Particularly, the guide pad 444 is pivotably coupled to the second portion 432*a* about a substantially horizontal axis 436*a* (see also FIG. 14).

With reference to FIG. 15, the roller accessory 400*a* includes an adjustment device in the form of a locking pivot or mechanism 448 for locking the first portion 424 to the second portion 432*a* to fix the spacing S1 between the respective axes 428, 436*a* of the rollers 408 and guide pad 444. Although illustrated and described in connection with the second construction of the roller accessory 400*a*, the locking mechanism 448 may also be utilized in the roller accessory 400 of FIGS. 10-12.

With reference to FIG. 15, the locking mechanism 448 includes a body 452 having a pin or a projection 456 extending therefrom, a spring 460 upwardly biasing the body 452, and a button 464, when depressed, engages the body 452 to cause the body 452 to move downwardly against the bias of the spring 460, and when released allows the spring 460 to move the body 452 back to its biased position (illustrated in FIG. 15). Specifically, the button 464 includes an inclined surface 468 that slidably engages a corresponding inclined surface 472 on the body 452. The mating surfaces 468, 472 facilitate the transformation of the substantially horizontal motion of the button 464 into substantially vertical motion of the body 452.

With continued reference to FIG. 15, the projection 456, in the "locking position" of the locking mechanism 448, is inserted into a corresponding aperture 476 in the first portion 424 to fix the spacing S1 and the angle D (see FIGS. 10 and 16). When the button 464 is depressed to actuate the locking mechanism 448 to its "unlocked position," the inclined surface 468 of the button 464 bears upon or engages the inclined surface 472 of the body 452, which causes the body 452 to move downwardly against the bias of the spring 460. As a result, the projection 456 disengages or is removed from the aperture 476 in the first portion 424, allowing the second portion 432 or 432*a* to pivot relative to the first portion 424 about the pivot axis 438. When the desired spacing S1 and angle D are attained, the button 464 may be released, causing the spring 460 to bias the body 452 upwardly to position the projection 456 within the nearest aperture 476 in the first portion 424. As shown in FIG. 15, a plurality of apertures 476 may be formed in the first portion 424 to provide a plurality of different configurations of the accessory 400, 400*a* and a plurality of different spacings S1 and angles D. FIG. 16 illustrates, in phantom, one alternate configuration of the accessory 400*a* in which the spacing S1 is increased, therefore causing angle D to decrease. Alternatively, any of a number of different locking mechanisms or devices may be utilized to lock the first portion 424 to the second portion 432 to fix the spacing S1 between the respective axes 428, 436 of the rollers 408, 412 or the spacing S1 between the respective axes 428, 436*a* of the rollers 408 and the guide pad 444.

With reference to FIGS. 11 and 12, the connector 420 extending from the frame 416 includes an insertion portion 440 configured substantially similar to the insertion portion 158 of the brush 62 of FIGS. 3, 4, 6, and 7. As such, the roller accessories 400, 400*a* may be coupled to the mount 54 via the receiving portion 150 in substantially the same way as the accessories 58 shown in FIG. 8.

With reference to FIGS. 10 and 16, the mount 54 and the roller accessories 400, 400*a* may be utilized to space the nozzle 46 a fixed distance from the support surface 404 as the gun assembly 22 is traversed across the support surface 404. Not only can the spacing of the nozzle 46 relative to the support surface 404 be varied by adjusting spacing between the rollers 408, 412 on the frame 416 as described above, or by adjusting the spacing between the rollers 408 and the guide pad 444, but the spacing of the nozzle 46 relative to the support surface 404 can also be varied by sliding the wand 18 along the axis 70 of the first receiving portion 66. Fixing the nozzle 46 a precise distance from the support surface 404 can increase the consistency of the cleaning performance of the spray. For example, when using the gun assembly 22 on a support surface 404 such as a patio, sidewalk, or driveway, without the mount 54, the roller accessories 400, 400*a*, or any of the accessories 58, "streaks" may form on the patio, sidewalk, or driveway as a result of inconsistent spacing of the nozzle 46 relative to the support surface 404. Such "streaks" are the result of one portion of the support surface 404 being more thoroughly cleaned than an adjacent portion and impart an undesirable appearance to the support surface 404. However, by using the gun assembly 22 in combination with the mount 54 and the roller accessories 400, 400*a* or any of the other accessories 58, the operator of the pressure washer 10 may traverse the support surface 404 with the gun assembly 22 without concentrating on maintaining a consistent spacing between the nozzle 46 and the support surface 404 because the roller accessories 400, 400*a* or any of the other accessories 58 fixes the spacing of the nozzle 46 relative to the support surface 404. As a result, the operator of the pressure washer 10 can achieve substantially streak-free cleaning of the support surface 404 while using less effort.

As previously stated, the frame 416 can be adjusted to vary the spacing of the nozzle 46 relative to the support surface 404, and the wand 18 is slidable relative to the mount 54 to vary the spacing of the nozzle 46 relative to the support surface 404. Such adjustability may allow for the same nozzle 46 to be used in multiple cleaning applications. For example, because the nozzle 46 outputs a fixed spray angle, varying the spacing between the nozzle 46 and the support surface 404 also varies the width of the contact area of the spray on the support surface 404. As such, the operator of the pressure washer 10 would not be required to change nozzles 46 to achieve a wider or more narrow contact area of the spray on the support surface 404.

In addition, such adjustability in the frame 416 and the mount 54 may allow for the same nozzle 46 to be used to clean support surfaces 404 of different materials. Depending on the material of the support surface 404 (e.g., concrete or wood), more or less pressure may be desirable for effective cleaning of the support surface 404. Varying the spacing of the nozzle 46 relative to the support surface 404 not only varies the width of the contact area of the spray on the support surface 404, but also varies the effective pressure of the spray on the support surface 404. For example, a concrete support surface 404 might require a higher-pressure spray for effective cleaning compared to a wooden support surface 404. Rather than changing nozzles 46, an operator of the pressure washer 10 might decrease the spacing between the nozzle 46 and the concrete support surface 404 to increase the effective pressure of the spray on the concrete support surface 404. Likewise, an operator of the pressure washer 10 might increase the spacing between the nozzle 46 and the wooden support surface 404 to decrease the effective pressure of the spray on the wooden support surface 404.

Figure 18:
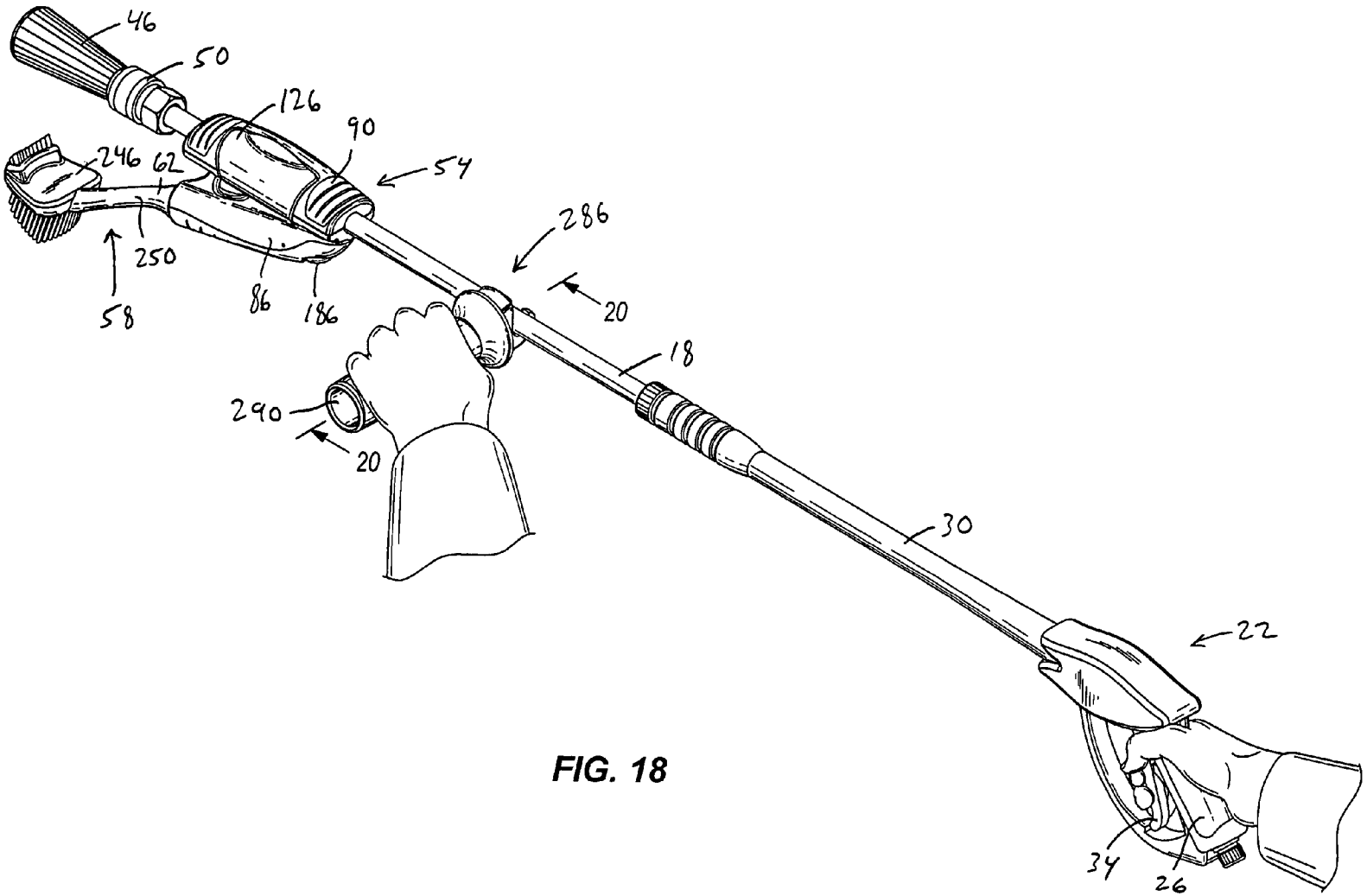
FIG. 18 is an enlarged perspective view of the gun assembly, wand, and mount of FIG. 1, illustrating an optional handle assembly coupled to the wand.

With reference to FIG. 18, a handle assembly 286 is shown coupled to the wand 18. The handle assembly 286 includes a grip or a handle 290 for an operator to grasp to facilitate maneuvering the gun assembly 22 and wand 18. The handle assembly 286 is movable along the length of the wand 18 and rotatable about the wand 18 to a position desired by the operator. When the handle assembly 286 is used in combination with the mount 54 and the accessory 58, the handle assembly 286 can be slid or moved to a position on the wand 18 at which the operator can exert more leverage on the wand 18, to compensate for the increased weight of the mount 54 and accessory 58 near the free end of the wand 18. Although FIG. 18 illustrates the handle assembly 286 being used in combination with the mount 54 and accessory 58, the handle assembly 286 may also be used separately from the mount 54 and accessory 58.

Figure 19:
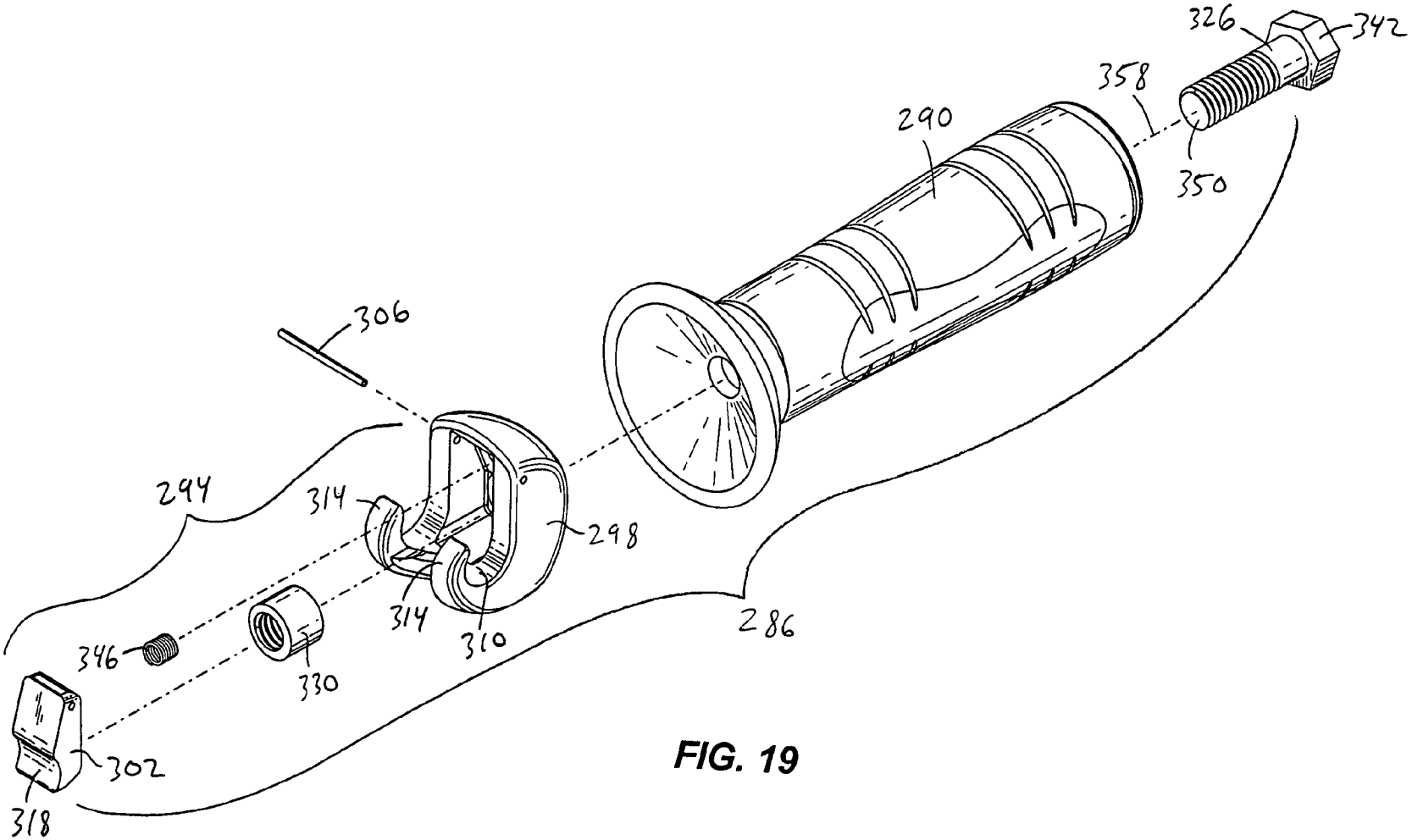
FIG. 19 is an enlarged, exploded perspective view of the handle assembly of FIG. 18.

FIG. 19 illustrates the components of the handle assembly 286. The handle assembly 286 includes a clamp 294 having a stationary portion 298 and a movable portion 302 pivotably coupled to the stationary portion 298. In the illustrated construction of the handle assembly 286, the movable portion 302 is pivotably coupled to the stationary portion 298 by a pin 306. In an alternative construction of the handle assembly 286, the movable portion 302 may be integrally formed with the stationary portion 298 and pivotably coupled to the stationary portion 298 by, for example, a living hinge.

Figure 20:
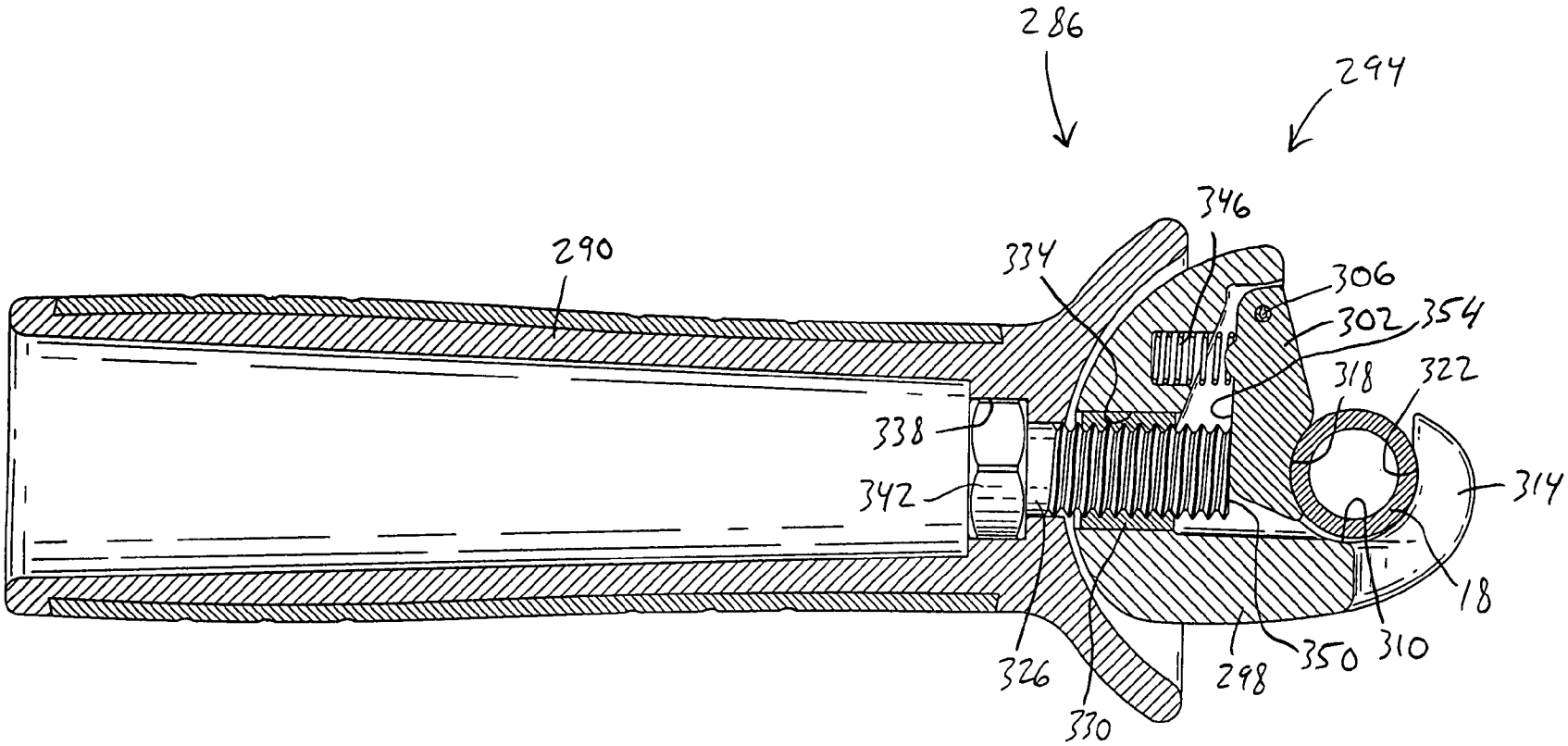
FIG. 20 is a cross-sectional view of the handle assembly of FIG. 18 through section 20-20 in FIG. 18, illustrating the handle assembly clamped to the wand.

The stationary portion 298 includes a cradle 310, in which the wand 18 is positioned, and two fingers 314 extending upwardly from the cradle 310. With reference to FIGS. 19-21, the movable portion 302 includes a surface 318 having a substantially similar curvature as that of the wand 18. Likewise, the fingers 314 include respective surfaces 322 each having a substantially similar curvature as that of the wand 18. As a result, the wand 18 is engageable by the surfaces 318, 322 of the movable portion 302 and the fingers 314 over a relatively large surface area of the wand 18. The clamping force exerted on the wand 18 is distributed over a larger area on the wand 18, particularly the area engaged by the curved surfaces 318, 322. Increased distribution of the clamping force on the wand 18 may reduce fatigue of the material of the clamp 294.

With reference to FIG. 19, in the illustrated construction of the handle assembly 286, the handle 290 is coupled to the stationary portion 298 by a threaded fastener 326. A threaded insert 330 is positioned and secured within a bore 334 through the stationary portion 298 (see also FIGS. 20 and 21) to receive the fastener 326. Alternatively, other fasteners may be used to couple the handle 290 to the stationary portion 298. The insert 330 may be secured within the bore 334 using any of a number of different methods, including, for example, using a press fit or molding the insert 330 into the stationary portion 298. With reference to FIGS. 20 and 21, the interior of the handle 290 includes a hexagonally-shaped recess 338 configured to receive a hexagonal head 342 of the fastener 326. When the head 342 of the fastener 326 is received in the hexagonal recess 338, the fastener 326 co-rotates with the handle 290. The fastener 326 may be secured to the handle 290 using any of a number of different methods, including, for example, using a press fit or molding the fastener 326 into the handle 290.

FIGS. 19-21 illustrate a spring 346 at least partially biasing the movable portion 302 toward the fingers 314. The length and spring rate of the spring 346 may be sized such that the spring 346 does not push the movable portion 302 against the fingers 314, but rather biases the movable portion 302 toward a neutral position with respect to the fingers 314 (e.g., the vertical position shown in FIG. 20).

With reference to FIGS. 20 and 21, an end 350 of the fastener 326 extends past the axial extent of the insert 330 to selectively engage a back surface 354 of the movable portion 302. Before coupling the handle assembly 286 to the wand 18, the end 350 of the fastener 326 must be sufficiently spaced from the back surface 354 of the movable portion 302 to allow the movable portion 302 to deflect away from its neutral position and away from the fingers 314 when inserting the wand 18 between the curved surfaces 218, 322 of the movable portion 302 and the fingers 314. To do this, the handle 290 is rotated with respect to the clamp 294 in a counter-clockwise ("CCW") direction looking into the handle 290, along a central axis 358 of the fastener 326 and handle 290 (see FIG. 21).

Then, to clamp the handle assembly 286 onto the wand 18, the wand 18 is positioned in the cradle 310 of the stationary portion 298, and the handle 290 is rotated in a clockwise ("CW") direction looking into the handle 290, along the central axis 358 until the end 350 of the fastener 326 abuts or engages the back surface 354 of the movable portion 302. Continued rotation of the handle 290 then pivots the movable portion 302 toward the wand 18 and clamps the wand 18 between the curved surfaces 318, 322 of the movable portion 302 and the fingers 314 (see FIG. 20). To release the handle assembly 286 from the wand 18, the handle 290 may be rotated in a CCW direction as described above to back-off the end 350 of the fastener 326 from the back surface 354 of the movable portion 302, therefore allowing the movable portion 302 to deflect away from the fingers 314, against the bias of the spring 346, and allowing the wand 18 to be removed from the cradle 310 (see FIG. 21).

Various features of the invention are set forth in the following claims.

What is claimed is:

1. A mount configured to couple a cleaning accessory to a wand of a pressurized fluid delivery apparatus, the mount comprising:

a first receiving portion configured to receive the wand therein, the first receiving portion defining a first axis along which the wand is slidable;

a locking member configured to secure the first receiving portion to the wand; and a second receiving portion extending from the first receiving portion, the second receiving portion configured to connect to an end of the cleaning accessory;

wherein the first receiving portion includes a first surface and a second surface movable with respect to the first surface, and wherein the locking member biases the second surface toward the first surface to secure the wand between the first and second surfaces.

2. A mount configured to couple a cleaning accessory to a wand of a pressurized fluid delivery apparatus, the mount comprising:

a first receiving portion configured to receive the wand therein, the first receiving portion defining a first axis along which the wand is slidable;

a locking member configured to secure the first receiving portion to the wand; and a second receiving portion extending from the first receiving portion, the second receiving portion configured to connect to an end of the cleaning accessory;

wherein the locking member comprises a first locking member, and wherein the mount further includes a second locking member having a finger extending into the second receiving portion to engage the cleaning accessory.

3. The mount of claim 2, wherein the finger is biased into engagement with the cleaning accessory by a spring, and wherein the cleaning accessory is releasable form the second receiving portion by moving the second locking member against the bias of the spring.

4. The mount of claim 2, wherein the second receiving portion defines a second axis, and wherein the second receiving portion is movable with respect to the first receiving portion to vary an angle between the first axis and the second axis.

5. A pressurized fluid delivery apparatus, comprising:

a pump configured to provide a pressurized fluid;

a wand configured to receive the pressurized fluid from the pump, the wand defining a first axis;

a cleaning accessory;

a mount coupling the cleaning accessory to the wand, the mount including a first receiving portion to receive the wand therein, the first receiving portion slidable along the first axis of the wand;

a locking member to secure the first receiving portion to the wand; and a second receiving portion extending from the first receiving portion, the second receiving portion connecting to an end of the cleaning accessory;

wherein the first receiving portion includes a first surface and a second surface movable with respect to the first surface, and wherein the locking member biases the second surface toward the first surface to secure the wand between the first and second surfaces.

6. A pressurized fluid delivery apparatus, comprising:

a pump configured to provide a pressurized fluid;

a wand configured to receive the pressurized fluid from the pump, the wand defining a first axis;

a cleaning accessory;

a mount coupling the cleaning accessory to the wand, the mount including a first receiving portion to receive the wand therein, the first receiving portion slidable along the first axis of the wand;

a locking member to secure the first receiving portion to the wand; and a second receiving portion extending from the first receiving portion, the second receiving portion connecting to an end of the cleaning accessory;

wherein the locking member comprises a first locking member, and wherein the mount further includes a second locking member having a finger extending into the second receiving portion to engage the cleaning accessory.

7. The pressurized fluid delivery apparatus of claim 6, wherein the finger is biased into engagement with the cleaning accessory by a spring, and wherein the cleaning accessory is releasable from the second receiving portion by moving the second locking member against the bias of the spring.

8. The pressurized fluid delivery apparatus of claim 6, wherein the cleaning accessory includes a slot engageable by the finger to secure the cleaning accessory to the second receiving portion.

9. The pressurized fluid delivery apparatus of claim 6, wherein the second receiving portion defines a second axis disposed at an acute angle with respect to the first axis.

10. The pressurized fluid delivery apparatus of claim 6, further comprising:

a gun that receives the pressurized fluid from the pump, the wand fluidly coupled to the gun to receive the pressurized fluid from the gun; and an extension including a first portion;

a second portion spaced from the first portion; and a free end spaced from the first and second positions;

wherein the first portion is coupled to at least one of the gun and the wand, wherein the second portion is coupled to the second receiving portion of the mount, and wherein the cleaning accessory is coupled to the free end of the extension.

11. The pressurized fluid delivery apparatus of claim 6, wherein the second receiving portion defines a second axis, and wherein the second receiving portion is movable with respect to the first receiving portion to vary an angle between the first axis and the second axis.

12. The pressurized fluid delivery apparatus of claim 6, further comprising a roller assembly configured to be alternatively coupled to the mount in place of the cleaning accessory, wherein the roller assembly includes a first roller;

a second roller;

a guide member spaced from a line intersecting the first roller and the second roller;

a frame coupled to first roller, the second roller, and the guide member; and a connector extending from the frame, the connector configured to couple the frame to the mount.

13. The roller assembly of claim 12, wherein the first roller is spaced from the second roller along the line by at least six inches, and wherein the guide member is spaced from the line by at least six inches.

14. The roller assembly of claim 12, further comprising an adjustment device configured to position the guide member at one of a plurality of distances from the line.

15. The roller assembly of claim 14, wherein the adjustment device includes a locking pivot.

16. The roller assembly of claim 12, wherein the guide member includes a third roller.

17. The roller assembly of claim 12, wherein the guide member includes a guide pad.

18. A pressurized fluid delivery apparatus, comprising:

a pump configured to provide a pressurized fluid;

a wand configured to receive the pressurized fluid from the pump, the wand defining a first axis;

a cleaning accessory;

a mount coupling the cleaning accessory to the wand, the mount including a first receiving portion to receive the wand therein, the first receiving portion slidable along the first axis of the wand;

a locking member to secure the first receiving portion to the wand; and a second receiving portion extending from the first receiving portion, the second receiving portion connecting to an end of the cleaning accessory;

wherein the cleaning accessory includes a first portion engageable with the second receiving portion of the mount, wherein the first portion defines a second axis, and wherein the cleaning accessory includes a second portion defining a third axis non-parallel with the second axis.

19. The pressurized fluid delivery apparatus of claim 18, wherein the cleaning accessory includes a first portion engageable with the second receiving portion, a second portion, a head portion, and a swivel coupling the second portion to the head portion to vary the orientation of the head portion with respect to the first axis.

20. A pressurized fluid delivery apparatus, comprising:

a pump configured to provide a pressurized fluid;

a wand configured to receive the pressurized fluid from the pump, the wand defining a first axis;

a cleaning accessory;

a mount coupling the cleaning accessory to the wand, the mount including a first receiving portion to receive the wand therein, the first receiving portion slidable along the first axis of the wand;

a locking member to secure the first receiving portion to the wand;

a second receiving portion extending from the first receiving portion, the second receiving portion connecting to an end of the cleaning accessory;

a handle assembly including a clamp having a first portion;

a second portion pivotably coupled to the first portion, the wand positioned between the first portion and the second portion; and a handle including a fastener projecting therefrom, the fastener coupling the handle to the clamp and engaging the second portion to claim the second portion against the wand upon relative rotation between the handle and the clamp.

21. The handle assembly of claim 20, wherein the first portion includes a first surface, wherein the second portion includes a second surface in facing relationship with the first surface, and wherein the wand is secured between the first and second surfaces upon relative rotation between the handle and the clamp.

* * * * *